US011279012B1

(12) United States Patent
Sollami

(10) Patent No.: US 11,279,012 B1
(45) Date of Patent: Mar. 22, 2022

(54) RETAINER INSERTION AND EXTRACTION TOOL

(71) Applicant: Phillip Sollami, Herrin, IL (US)

(72) Inventor: Phillip Sollami, Herrin, IL (US)

(73) Assignee: The Sollami Company, Herrin, IL (US)

( * ) Notice: Subject to any disclaimer, the term of this patent is extended or adjusted under 35 U.S.C. 154(b) by 300 days.

(21) Appl. No.: 15/705,537

(22) Filed: Sep. 15, 2017

(51) Int. Cl.
*B25B 31/00* (2006.01)
*E21C 35/19* (2006.01)

(52) U.S. Cl.
CPC ..... *B25B 31/00* (2013.01); *E21C 35/19* (2013.01)

(58) Field of Classification Search
CPC ..... B25G 1/085; B25B 31/00; B25B 33/00; B25B 27/00; B25B 27/146; B25B 27/02; B25B 27/20; B25C 11/00; B25C 11/02
USPC ..... 29/244, 8; 16/430; 81/489, 44
See application file for complete search history.

(56) References Cited

U.S. PATENT DOCUMENTS 220,933 A * 10/1879 McGill ..... B25C 1/02 81/44
337,212 A * 3/1886 Van Dusen ..... B25C 1/02 81/44
1,628,897 A * 5/1927 Mills ..... B25G 3/32 16/422
2,382,947 A 7/1944 Brozek
2,557,000 A * 6/1951 Holmes ..... B25C 1/02 29/244
2,783,799 A * 3/1957 Hart ..... B25C 1/02 81/44
3,060,441 A * 10/1962 Henning ..... B25C 1/02 227/147
3,067,446 A * 12/1962 McGauley ..... A46B 5/02 15/143.1

(Continued)

FOREIGN PATENT DOCUMENTS

DE 102004049710 4/2006
DE 102011079115 1/2013

(Continued)

OTHER PUBLICATIONS

"Fastener Design Course." NASA. Jun. 1997. <https://ntrs.nasa.gov/archive/nasa/casi.ntrs.nasa.gov/20110016427.pdf>. pp. 1, 2, 255-257. (Year: 1997).*

*Primary Examiner* — Joel D Crandall
(74) *Attorney, Agent, or Firm* — Mercedes V. O'Connor; Rockman Videbeck & O'Connor

(57) ABSTRACT

A retainer insertion and extraction tool that includes a shaft or handle, a retainer extraction pin at a distal end of the shaft, and a retainer receiving component at a forward end of the shaft. The retainer receiving component includes an annular, generally cylindrical, or cylindrical hammer face mounting, a hammer face, and a retainer capture base that includes a notch configured to receive a magnet and an extending leading edge that, in combination with the notch and magnet, is configured to receive and retain a retainer. The retainer receiving component is configured to insert the retainer into a groove of a bit by applying manual force to hammer face of the hammer face mounting. The retainer extraction pin is configured to remove the retainer from the groove of the bit by applying manual force to the forward end of the shaft, allowing the shaft to pivot against a fulcrum of a base block.

16 Claims, 22 Drawing Sheets

(56) References Cited

U.S. PATENT DOCUMENTS 3,342,532 A 9/1967 Krekeler
3,397,012 A 8/1968 Krekeler
3,476,438 A 11/1969 Bower, Jr.
3,519,309 A 7/1970 Engle
3,833,264 A 9/1974 Elders
3,833,265 A 9/1974 Elders
3,865,437 A 2/1975 Crosby
4,084,856 A 4/1978 Emmerich
4,141,129 A * 2/1979 Martini ..... B23P 19/084 29/235
4,247,150 A 1/1981 Wrulich et al.
RE30,807 E 12/1981 Elders
4,310,939 A 1/1982 Iijima
4,453,775 A 6/1984 Clemmow
4,478,298 A 10/1984 Hake
4,489,986 A 12/1984 Dziak
4,520,997 A * 6/1985 Lorton, Sr. ..... B25C 3/006 254/26 R
4,525,178 A 6/1985 Hall
4,561,698 A 12/1985 Beebe
4,570,726 A 2/1986 Hall
4,604,106 A 8/1986 Hall
4,632,463 A 12/1986 Sterwerf, Jr.
4,658,457 A * 4/1987 Rokita ..... B25C 11/00 15/235.3
4,694,918 A 9/1987 Hall
4,702,525 A 10/1987 Sollami
4,763,956 A 8/1988 Emmerich
4,768,271 A * 9/1988 Jacob ..... B25B 27/00 254/28
4,811,801 A 3/1989 Salesky
4,818,027 A 4/1989 Simon
4,821,819 A 4/1989 Whysong
4,844,550 A 7/1989 Beebe
4,915,455 A 4/1990 O'Niell
4,944,559 A 7/1990 Sionett
5,067,775 A 11/1991 D'Angelo
5,088,797 A 2/1992 O'Neill
5,098,167 A 3/1992 Latham
5,159,233 A 10/1992 Sponseller
5,161,627 A 11/1992 Burkett
5,191,690 A * 3/1993 Koehn ..... B25B 27/02 29/275
5,273,343 A 12/1993 Ojanen
5,287,937 A 2/1994 Sollami
5,302,005 A 4/1994 O'Neill
5,303,984 A 4/1994 Ojanen
5,352,079 A 10/1994 Croskey
5,370,448 A 12/1994 Sterwerf, Jr.
5,374,111 A 12/1994 Den Besten
5,415,462 A 5/1995 Massa
5,417,475 A 5/1995 Graham et al.
5,458,210 A 10/1995 Sollami
5,484,191 A 1/1996 Sollami
5,492,188 A 2/1996 Smith et al.
5,551,760 A 9/1996 Sollami
5,607,206 A 3/1997 Siddle
5,628,549 A 5/1997 Ritchey
5,720,528 A 2/1998 Ritchey
5,725,283 A 3/1998 O'Neill
5,823,632 A 10/1998 Burkett
5,842,389 A * 12/1998 Halstead ..... B25C 9/00 81/44
5,924,501 A 7/1999 Tibbitts
5,931,542 A 8/1999 Britzke
5,934,854 A 8/1999 Krautkremer et al.
5,992,405 A 11/1999 Sollami
D420,013 S 2/2000 Warren
6,019,434 A 2/2000 Emmerich
6,102,486 A 8/2000 Briese
6,176,552 B1 1/2001 Topka, Jr.
6,196,340 B1 3/2001 Jensen et al.
6,199,451 B1 3/2001 Sollami
6,250,535 B1 6/2001 Sollami
6,331,035 B1 12/2001 Montgomery, Jr.
6,341,823 B1 1/2002 Sollami
6,357,832 B1 3/2002 Sollami
6,371,567 B1 4/2002 Sollami
6,382,733 B1 5/2002 Parrott
6,428,110 B1 8/2002 Ritchey et al.
6,508,516 B1 1/2003 Kammerer
D471,211 S 3/2003 Sollami
6,585,326 B2 7/2003 Sollami
6,685,273 B1 2/2004 Sollami
6,692,083 B2 2/2004 Latham
D488,170 S 4/2004 Sollami
6,733,087 B2 5/2004 Hall
6,739,327 B2 5/2004 Sollami
6,786,557 B2 9/2004 Montgomery
6,824,225 B2 11/2004 Stiffler
6,846,045 B2 1/2005 Sollami
6,854,810 B2 2/2005 Montgomery
6,866,343 B2 3/2005 Holl et al.
6,968,912 B2 11/2005 Sollami
6,994,404 B1 2/2006 Sollami
7,089,640 B2 * 8/2006 Tanaka ..... B23P 19/084 29/229
7,097,258 B2 8/2006 Sollami
7,118,181 B2 10/2006 Frear
7,150,505 B2 12/2006 Sollami
7,195,321 B1 3/2007 Sollami
7,210,744 B2 5/2007 Montgomery
7,229,136 B2 6/2007 Sollami
7,234,782 B2 6/2007 Stehney
D554,162 S 10/2007 Hall
7,320,505 B1 1/2008 Hall
7,338,135 B1 3/2008 Hall
7,347,292 B1 3/2008 Hall
D566,137 S 4/2008 Hall
7,353,893 B1 4/2008 Hall
7,384,105 B2 6/2008 Hall
7,396,086 B1 6/2008 Hall
7,401,862 B2 7/2008 Holl et al.
7,401,863 B1 7/2008 Hall
7,410,221 B2 8/2008 Hall
7,413,256 B2 8/2008 Hall
7,413,258 B2 8/2008 Hall
7,419,224 B2 9/2008 Hall
7,445,294 B2 11/2008 Hall
D581,952 S 12/2008 Hall
7,464,993 B2 12/2008 Hall
7,469,756 B2 12/2008 Hall
7,469,971 B2 12/2008 Hall
7,469,972 B2 12/2008 Hall
7,475,948 B2 1/2009 Hall
7,523,794 B2 4/2009 Hall
7,568,770 B2 8/2009 Hall
7,569,249 B2 8/2009 Hall
7,571,782 B2 8/2009 Hall
7,575,425 B2 8/2009 Hall
7,588,102 B2 9/2009 Hall
7,594,703 B2 9/2009 Hall
7,600,544 B1 10/2009 Sollami
7,600,823 B2 10/2009 Hall
7,628,233 B1 12/2009 Hall
7,635,168 B2 12/2009 Hall
7,637,574 B2 12/2009 Hall
7,648,210 B2 1/2010 Hall
7,665,552 B2 2/2010 Hall
7,669,938 B2 3/2010 Hall
7,681,338 B2 3/2010 Hall
7,712,693 B2 5/2010 Hall
7,717,365 B2 5/2010 Hall
7,722,127 B2 5/2010 Hall
7,789,468 B2 9/2010 Sollami
7,832,808 B2 11/2010 Hall
7,883,155 B2 2/2011 Sollami
7,950,745 B2 5/2011 Sollami
7,963,617 B2 6/2011 Hall
7,992,944 B2 8/2011 Hall
7,992,945 B2 8/2011 Hall
7,997,660 B2 8/2011 Monyak et al.
7,997,661 B2 8/2011 Hall

(56) References Cited

U.S. PATENT DOCUMENTS 8,007,049 B2 8/2011 Fader
8,007,051 B2 8/2011 Hall
8,029,068 B2 10/2011 Hall
8,033,615 B2 10/2011 Hall
8,033,616 B2 10/2011 Hall
8,038,223 B2 10/2011 Hall
8,061,784 B2 11/2011 Hall
8,109,349 B2 2/2012 Hall
8,118,371 B2 2/2012 Hall
8,136,887 B2 3/2012 Hall
8,201,892 B2 6/2012 Hall
8,215,420 B2 7/2012 Hall
8,292,372 B2 10/2012 Hall
8,414,085 B2 4/2013 Hall
8,449,039 B2 5/2013 Hall
8,468,630 B2 * 6/2013 Barnhart ..... B25B 27/0078 7/143
8,485,609 B2 7/2013 Hall
8,500,209 B2 8/2013 Hall
8,540,320 B2 9/2013 Sollami
RE44,690 E 1/2014 Sollami
8,622,482 B2 1/2014 Sollami
8,622,483 B2 1/2014 Sollami
8,646,848 B2 2/2014 Hall
8,728,382 B2 5/2014 Hall
9,004,610 B2 4/2015 Erdmann et al.
9,028,008 B1 5/2015 Bookhamer
9,039,099 B2 5/2015 Sollami
9,316,061 B2 4/2016 Hall
9,518,464 B2 12/2016 Sollami
9,879,531 B2 1/2018 Sollami
9,909,416 B1 3/2018 Sollami
9,976,418 B2 5/2018 Sollami
9,988,903 B2 6/2018 Sollami
10,072,501 B2 9/2018 Sollami
10,105,870 B1 10/2018 Sollami
10,107,097 B1 10/2018 Sollami
10,107,098 B2 10/2018 Sollami
10,180,065 B1 1/2019 Sollami
10,260,342 B1 4/2019 Sollami
10,323,515 B1 6/2019 Sollami
10,337,324 B2 7/2019 Sollami
10,370,966 B1 8/2019 Sollami
10,385,689 B1 8/2019 Sollami
10,415,386 B1 9/2019 Sollami
10,502,056 B2 12/2019 Sollami
2002/0074850 A1 6/2002 Montgomery, Jr.
2002/0074851 A1 6/2002 Montgomery, Jr.
2002/0109395 A1 8/2002 Sollami
2002/0167216 A1 11/2002 Sollami
2002/0192025 A1 12/2002 Johnson
2003/0015907 A1 1/2003 Sollami
2003/0047985 A1 3/2003 Stiffler
2003/0052530 A1 3/2003 Sollami
2003/0122414 A1 7/2003 Sollami
2003/0209366 A1 11/2003 McAlvain
2004/0004389 A1 1/2004 Latham
2004/0174065 A1 9/2004 Sollami
2005/0212345 A1 9/2005 Sleep et al.
2006/0071538 A1 4/2006 Sollami
2006/0186724 A1 8/2006 Stehney
2006/0261663 A1 11/2006 Sollami
2007/0013224 A1 1/2007 Stehney
2007/0040442 A1 2/2007 Weaver
2007/0052279 A1 3/2007 Sollami
2008/0035386 A1 2/2008 Hall et al.
2008/0036276 A1 2/2008 Hall et al.
2008/0036283 A1 2/2008 Hall et al.
2008/0100124 A1 5/2008 Hall et al.
2008/0145686 A1 6/2008 Mirchandani
2008/0163471 A1 * 7/2008 Spaulding ..... B25B 27/00 29/221.5
2008/0164747 A1 7/2008 Weaver et al.
2008/0284234 A1 11/2008 Hall et al.
2009/0146491 A1 6/2009 Fader et al.
2009/0160238 A1 6/2009 Hall et al.
2009/0256413 A1 10/2009 Majagi
2009/0261646 A1 10/2009 Ritchie et al.
2009/0278334 A1 * 11/2009 Carr ..... B60D 1/02 280/515
2010/0045094 A1 2/2010 Sollami
2010/0192345 A1 * 8/2010 Monyak ..... B25B 27/20 29/278
2010/0238770 A1 * 9/2010 Speichinger ..... G04B 37/1486 368/282
2010/0244545 A1 9/2010 Hall
2010/0253130 A1 10/2010 Sollami
2010/0320003 A1 12/2010 Sollami
2010/0320829 A1 12/2010 Sollami
2011/0006588 A1 1/2011 Monyak et al.
2011/0089747 A1 4/2011 Helsel
2011/0175430 A1 7/2011 Heiderich et al.
2011/0204703 A1 8/2011 Sollami
2011/0254350 A1 10/2011 Hall
2011/0314614 A1 * 12/2011 Barnhart ..... B25B 27/0078 7/100
2012/0001475 A1 1/2012 Dubay et al.
2012/0027514 A1 2/2012 Hall
2012/0056465 A1 3/2012 Gerer et al.
2012/0068527 A1 3/2012 Erdmann
2012/0104830 A1 5/2012 Monyak et al.
2012/0181845 A1 7/2012 Sollami
2012/0242136 A1 9/2012 Ojanen
2012/0248663 A1 10/2012 Hall
2012/0261977 A1 10/2012 Hall
2012/0280559 A1 11/2012 Watson
2012/0286559 A1 11/2012 Sollami
2012/0319454 A1 12/2012 Swope
2013/0169023 A1 7/2013 Monyak
2013/0181501 A1 7/2013 Hall et al.
2013/0199693 A1 8/2013 Tank et al.
2013/0307316 A1 11/2013 Roetsch et al.
2014/0035346 A1 2/2014 Fundakowski et al.
2014/0110991 A1 4/2014 Sollami
2014/0232172 A1 8/2014 Roth et al.
2014/0262541 A1 9/2014 Parsana et al.
2014/0326516 A1 11/2014 Haugvaldstad
2015/0028656 A1 1/2015 Sollami
2015/0035343 A1 2/2015 Ojanen
2015/0137579 A1 5/2015 Lachmann et al.
2015/0198040 A1 7/2015 Voitic et al.
2015/0240634 A1 8/2015 Sollami
2015/0285074 A1 10/2015 Sollami
2015/0292325 A1 10/2015 Sollami
2015/0300166 A1 10/2015 Ries et al.
2015/0308488 A1 10/2015 Kahl
2015/0315910 A1 11/2015 Sollami
2015/0354285 A1 12/2015 Hall
2016/0102550 A1 4/2016 Paros et al.
2016/0194956 A1 7/2016 Sollami
2016/0229084 A1 8/2016 Lehnert
2016/0237818 A1 8/2016 Weber et al.
2017/0001292 A1 * 1/2017 Harrison ..... B25D 1/14
2017/0089198 A1 3/2017 Sollami
2017/0101867 A1 4/2017 Hall et al.
2017/0259416 A1 * 9/2017 Calman ..... B44D 3/22

FOREIGN PATENT DOCUMENTS

DE 202012100353 6/2013
DE 102015121953 7/2016
DE 102016118658 3/2017
EP 3214261 9/2017
GB 1114156 5/1968
GB 2483157 2/2012
GB 2534370 7/2016
WO 2008105915 A2 9/2008
WO 2008105915 A3 9/2008
WO 2009006612 1/2009

* cited by examiner

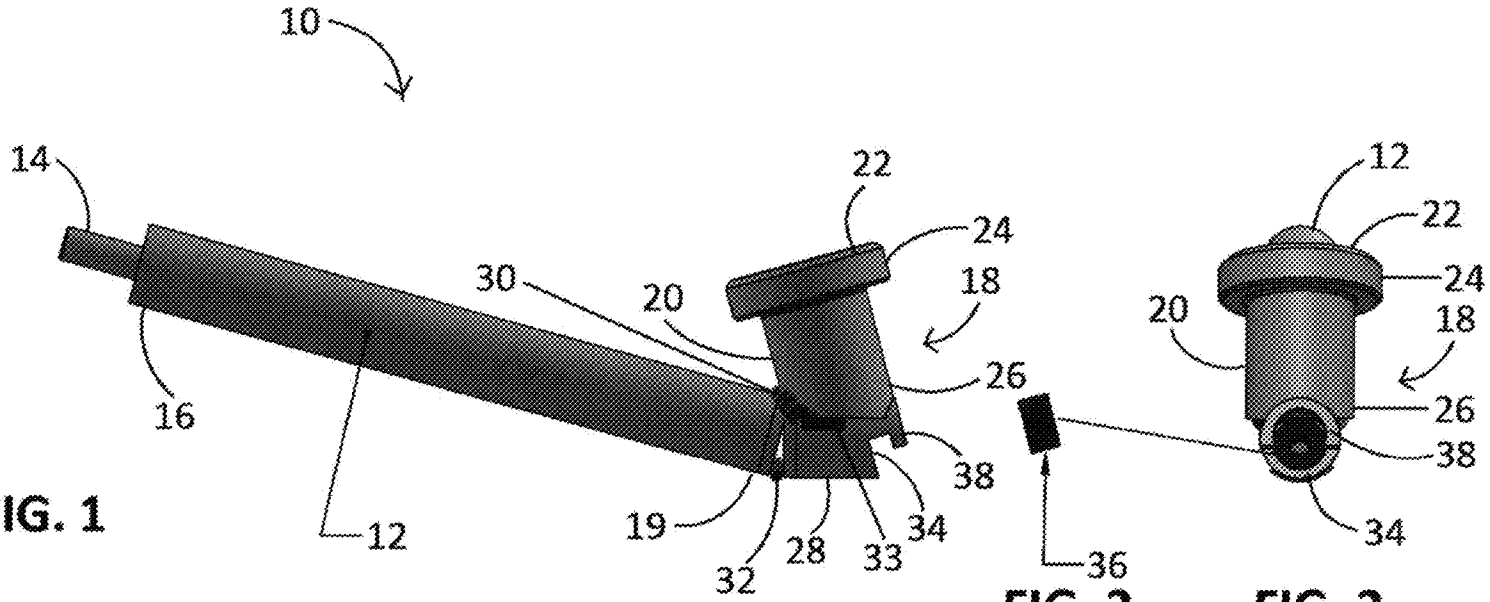
FIG. 1
FIG. 2
FIG. 3
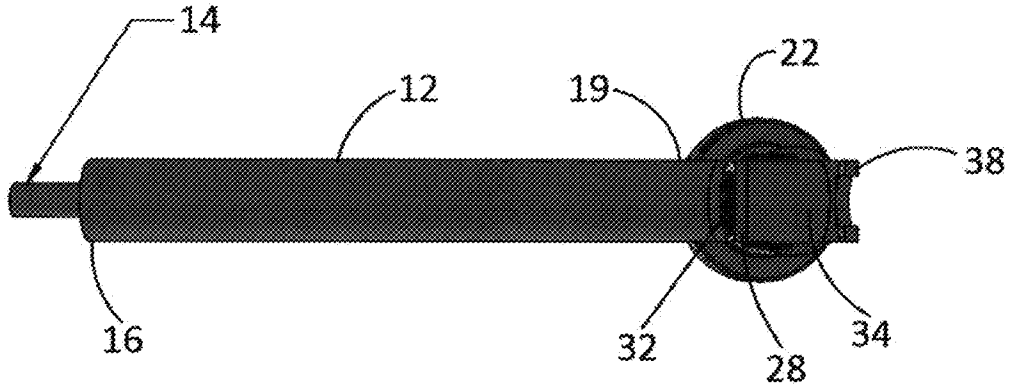
FIG. 4

RETAINER INSERTION AND EXTRACTION TOOL

TECHNICAL FIELD

This disclosure relates to a retainer insertion and extraction tool for bit assemblies used in mining, highway construction, and trenching equipment.

BACKGROUND

Mining, highway construction, and trenching equipment is operated using a rotatable, cylindrical drum or chain that includes a plurality of bit holder blocks mounted onto the drum or chain in a herringbone, V-shape, or spiral configuration. The equipment utilizes bits traditionally set in a bit assembly having a bit holder, and/or bit sleeve, and a bit holder block. The bit holder or bit sleeve is retained within a bore in the bit holder block. The combinations of bit assemblies have been utilized to remove material from the terra firma, such as degrading the surface of the earth, minerals, cement, concrete, macadam or asphalt pavement. The forces and vibrations exerted on the bit assemblies from the harsh road degrading environment may cause the bit holder to move within the bore of the bit holder block. Retainers have been used to allow bit rotational movement and to retain the bit within the bit holder, the bit sleeve, and/or the bit holder block. As bits are worn through underground mining, the retainer needs to be removed and the bit needs to be replaced. A retainer insertion and extraction tool can facilitate both removal of the retainer from the worn out bit and insertion of a new retainer around a new bit shank. The retainer insertion and extraction tool allows for quick removal and insertion of the retainer while requiring the user to exert minimal force for removal and insertion of the retainer.

SUMMARY

This disclosure relates generally to bit assemblies for mining, highway construction, and trenching equipment. One implementation of the teachings herein is a tool for insertion and extraction of a retainer that includes a first shaft; a second shaft extending past a distal end of the first shaft; and a receiving component laterally extending from a forward end of the first shaft, the receiving component adapted to receive the retainer.

These and other aspects of the present disclosure are disclosed in the following detailed description of the embodiments, the appended claims and the accompanying figures.

BRIEF DESCRIPTION OF THE DRAWINGS

The various features, advantages, and other uses of the apparatus will become more apparent by referring to the following detailed description and drawings, wherein like reference numerals refer to like parts throughout the several views. It is emphasized that, according to common practice, the various features of the drawings are not to-scale. On the contrary, the dimensions of the various features are arbitrarily expanded or reduced for clarity.

FIG. 1 is a side elevation view of a first embodiment of a retainer insertion and extraction tool in accordance with implementations of this disclosure;

FIG. 2 is a side elevation view of a magnet used in the first embodiment of the retainer insertion and extraction tool in accordance with implementations of this disclosure;

FIG. 3 is a front elevation view of the first embodiment of the retainer insertion and extraction tool in accordance with implementations of this disclosure;

FIG. 4 is a bottom elevation view of the first embodiment of the retainer insertion and extraction tool in accordance with implementations of this disclosure;

DETAILED DESCRIPTION

Figure 6:
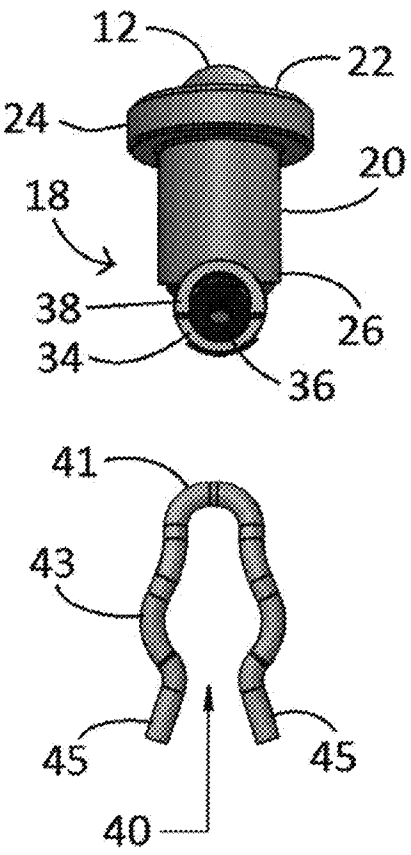
FIG. 6 is a front elevation view of the first embodiment of the retainer insertion and extraction tool, showing the retainer apart from the retainer insertion and extraction tool, in accordance with implementations of this disclosure.

Mining, highway construction, and trenching equipment is operated using a rotatable, cylindrical drum or chain that includes a plurality of bit holder blocks mounted onto the drum or chain in a herringbone, V-shape, or spiral configuration. The equipment utilizes bits traditionally set in a bit assembly having a bit holder, and/or bit sleeve, and a bit holder block. The bit holder or bit sleeve is retained within a bore in the bit holder block, hereinafter referred to as base blocks. The combinations of bit assemblies have been utilized to remove material from the terra firma, such as degrading the surface of the earth, minerals, cement, concrete, macadam or asphalt pavement. The forces and vibrations exerted on the bit assemblies from the harsh road degrading environment may cause the bit holder to move within the bore of the base block. Retainers have been used to allow bit rotational movement and to retain the bit within the bit holder, bit sleeve, and/or base block. As bits are worn through underground mining, the retainer needs to be removed and the bit needs to be replaced. A retainer insertion and extraction tool can facilitate both removal of the retainer from the worn out bit and insertion of a new retainer around a new bit shank. The retainer insertion and extraction tool allows for quick removal and insertion of the retainer while requiring the user to exert minimal force for removal and insertion of the retainer.

Referring to FIGS. 1-4, a first embodiment of a retainer insertion and extraction tool 10 comprises a shaft or handle 12, a retainer extraction pin 14 at a distal end 16 of the shaft 12, and a retainer receiving component 18 at a forward end 19 of the shaft 12. In other embodiments, the retainer extraction pin 14 can be a press fitted dowel pin, a press fitted roll pin, and/or a machined feature as an integral part of the shaft 12. The retainer receiving component 18 comprises an annular or cylindrical hammer face mounting 20, a hammer face 22 at a top end 24 of the cylindrical hammer face mounting 20, and a retainer capture base 28 at a bottom end 26 of the cylindrical hammer face mounting 20. In this illustrated embodiment, the cylindrical hammer face mounting 20 is fastened to the shaft 12 at location 30 at an acute angle to the shaft 12 using welding, the retainer capture base 28 is fastened to the shaft 12 at location 32 at an obtuse angle to the shaft 12 using welding, and the retainer capture base 28 is also fastened to the cylindrical hammer mounting face 20 at location 33 using welding. In other embodiments, the cylindrical hammer mounting face 20 and the retainer capture base 28 can be fastened using braising, or any other fastening means as is known in the art. In another embodiment the retainer insertion and extraction tool 10, cylindrical hammer mounting face 20, and retainer capture base 28 can be integrally formed in one piece.

Referring to FIGS. 1, 3, and 5-8, the retainer capture base 28 comprises an arcuate, annular, and/or cylindrical notch 34 configured to receive and engage a magnet 36. The retainer capture base 28 also comprises an extending leading edge 38 that, in combination with the cylindrical notch 34 and magnet 36, is configured to receive and retain a retainer 40 (FIGS. 5-14 and 20-25). The magnet 36 and the leading edge 38 both function to maintain the retainer 40 within the retainer capture base 28, shown in FIGS. 7 and 8, prior to insertion of the retainer 40 onto a shank 42 of a bit 44. The retainer 40 includes an arcuate top segment 41, and arcuate middle segment 43 of a larger radius than the arcuate top segment 41, and a pair of legs 45, shown in detail in FIGS. 6 and 8.

Figure 5:
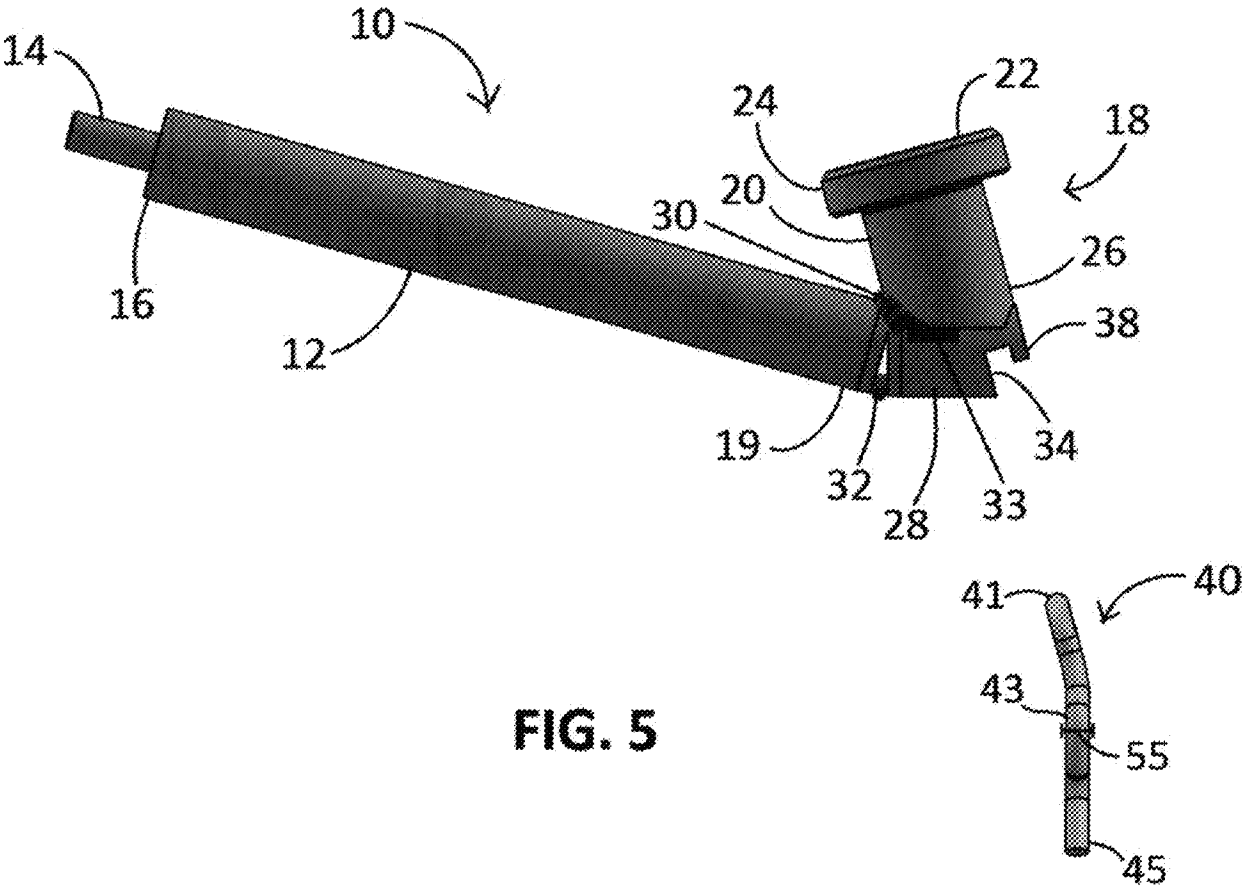
FIG. 5 is a side elevation view of the first embodiment of the retainer insertion and extraction tool, showing the retainer apart from the retainer insertion and extraction tool, in accordance with implementations of this disclosure.
Figure 8:
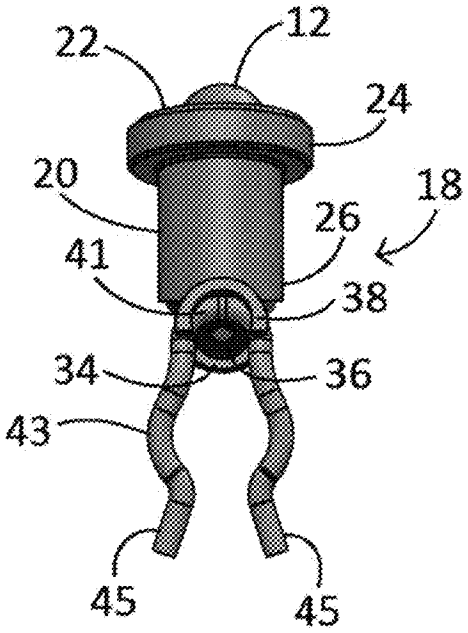
FIG. 8 is a front elevation view of the first embodiment of the retainer insertion and extraction tool, showing the retainer held by the retainer insertion and extraction tool, in accordance with implementations of this disclosure.
Figure 7:
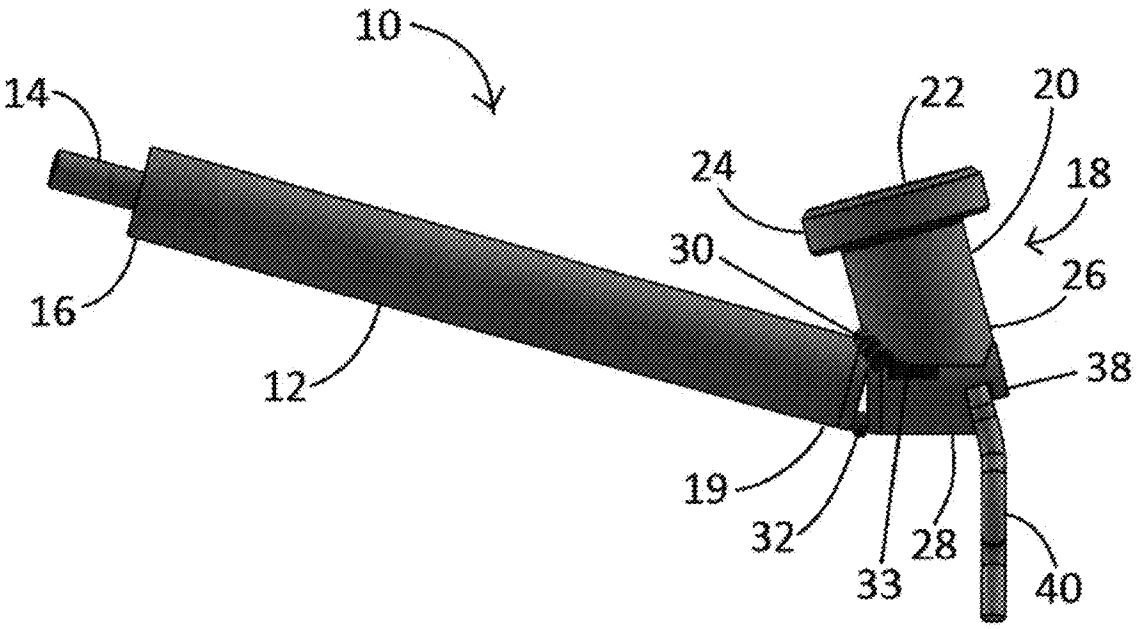
FIG. 7 is a side elevation view of the first embodiment of the retainer insertion and extraction tool, showing the retainer held by the retainer insertion and extraction tool, in accordance with implementations of this disclosure.
Figure 10:
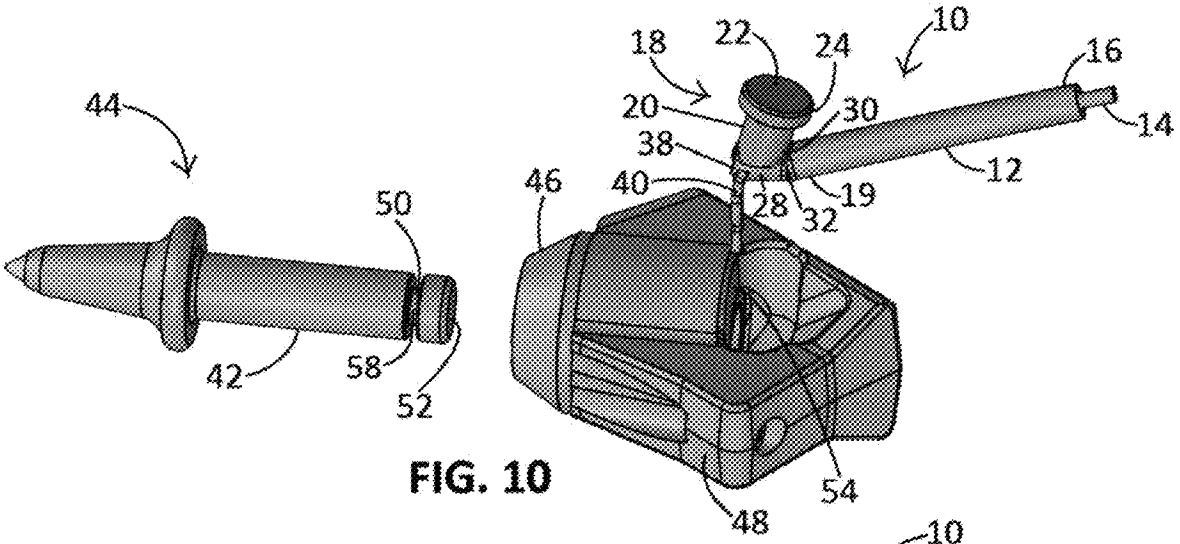
FIG. 10 is a side perspective view of the first embodiment of the retainer insertion and extraction tool, shown prior to insertion of a bit and the retainer, in accordance with implementations of this disclosure.
Figure 11:
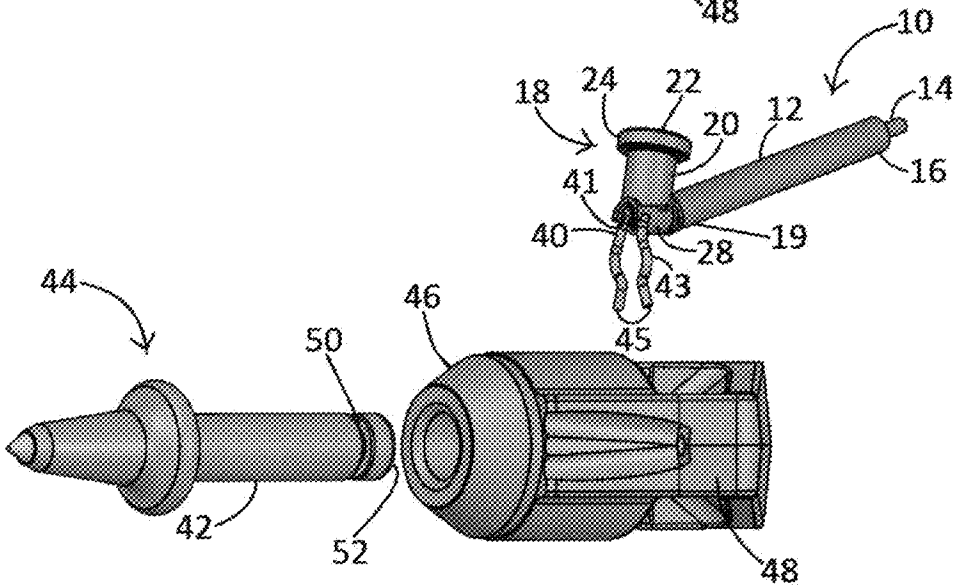
FIG. 11 is a perspective view of the first embodiment of the retainer insertion and extraction tool, shown prior to insertion of a bit and the retainer, in accordance with implementations of this disclosure.
Figure 9:
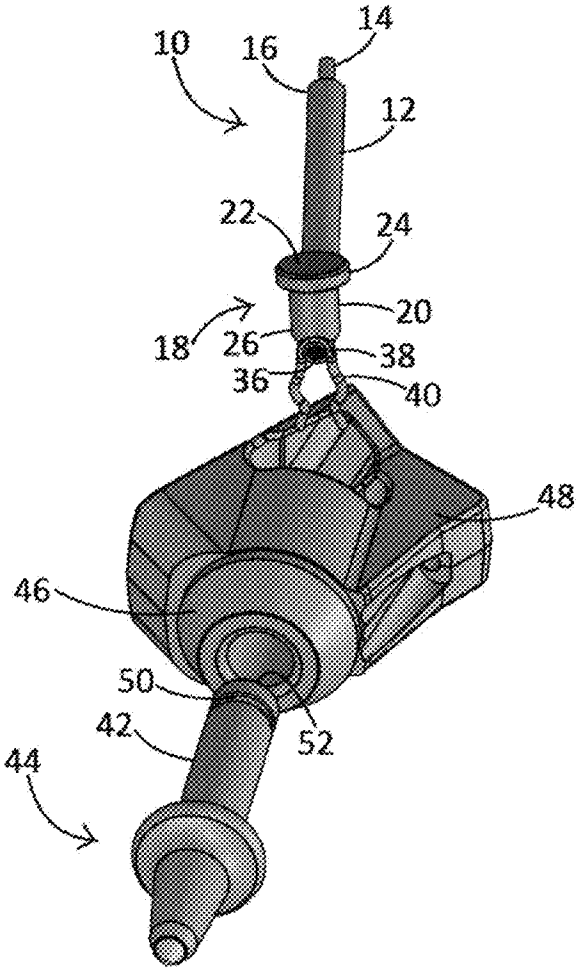
FIG. 9 is a front elevation view of the first embodiment of the retainer insertion and extraction tool, shown prior to insertion of a bit and the retainer, in accordance with implementations of this disclosure.
Figure 13:
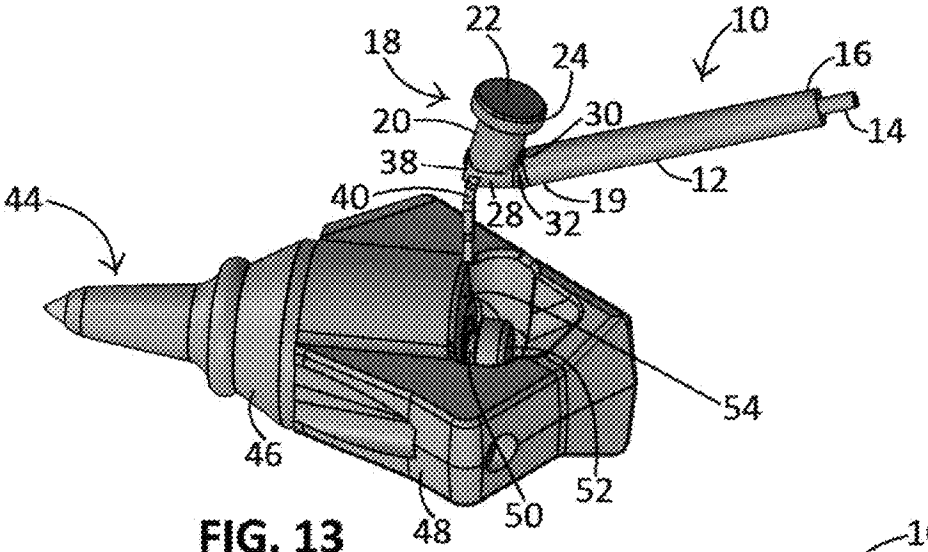
FIG. 13 is a side perspective view of the first embodiment of the retainer insertion and extraction tool, shown after insertion of the bit and prior to insertion of the retainer, in accordance with implementations of this disclosure.
Figure 14:
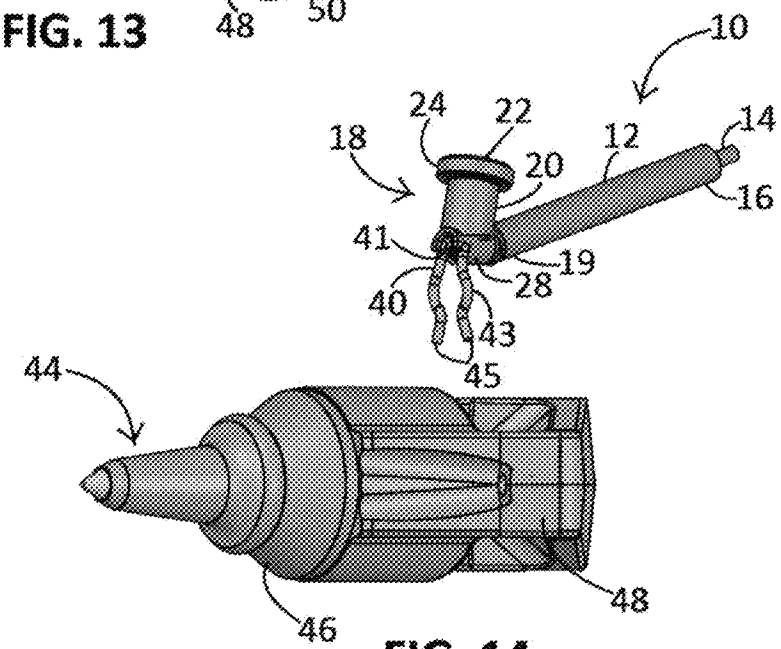
FIG. 14 is a perspective view of the first embodiment of the retainer insertion and extraction tool, shown after insertion of the bit and prior to insertion of the retainer, in accordance with implementations of this disclosure.
Figure 12:
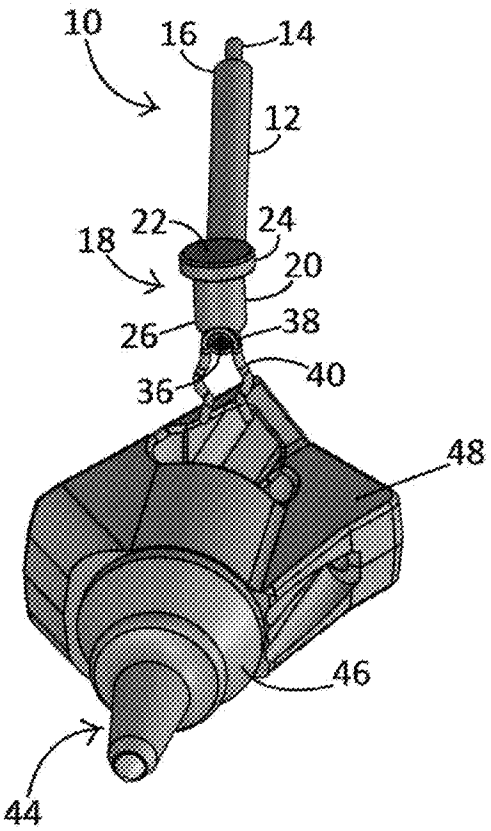
FIG. 12 is a front elevation view of the first embodiment of the retainer insertion and extraction tool, shown after insertion of the bit and prior to insertion of the retainer, in accordance with implementations of this disclosure.
Figure 16:
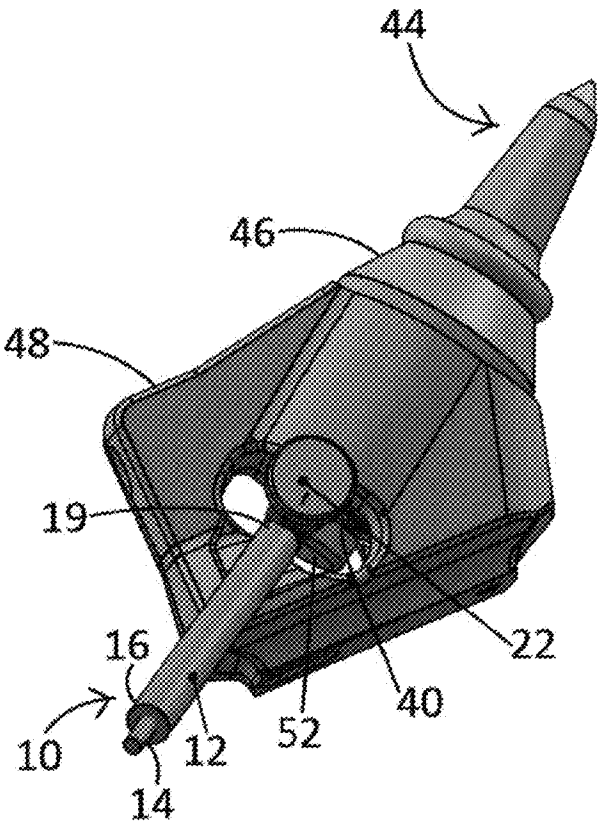
FIG. 16 is a top elevation view of the first embodiment of the retainer insertion and extraction tool, shown positioned when the retainer is fully inserted onto a shank of the bit, in accordance with implementations of this disclosure.
Figure 15:
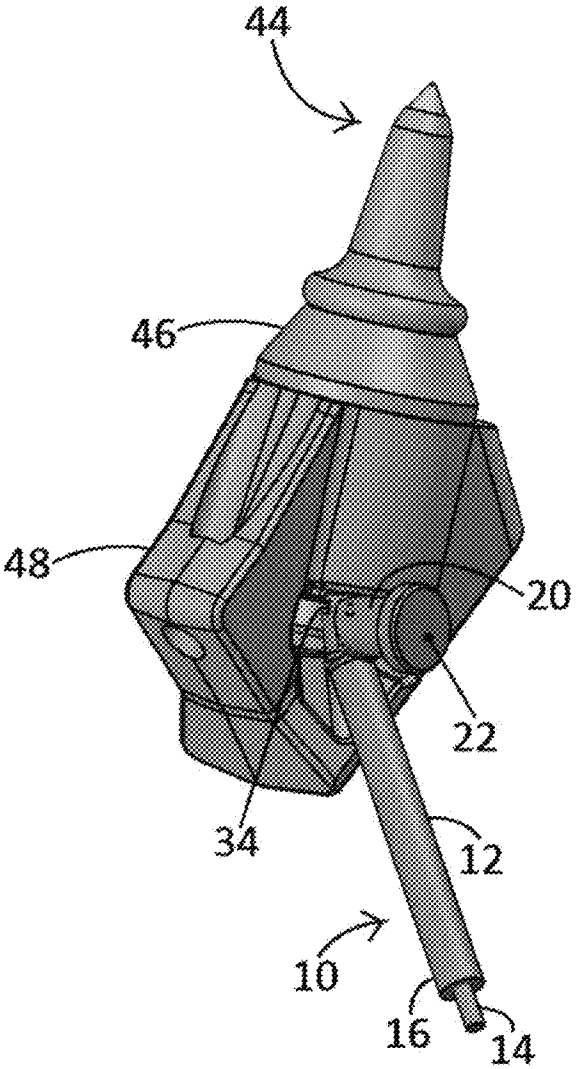
FIG. 15 is a side perspective view of the first embodiment of the retainer insertion and extraction tool, shown positioned when the retainer is fully inserted onto a shank of the bit, in accordance with implementations of this disclosure.
Figure 18:
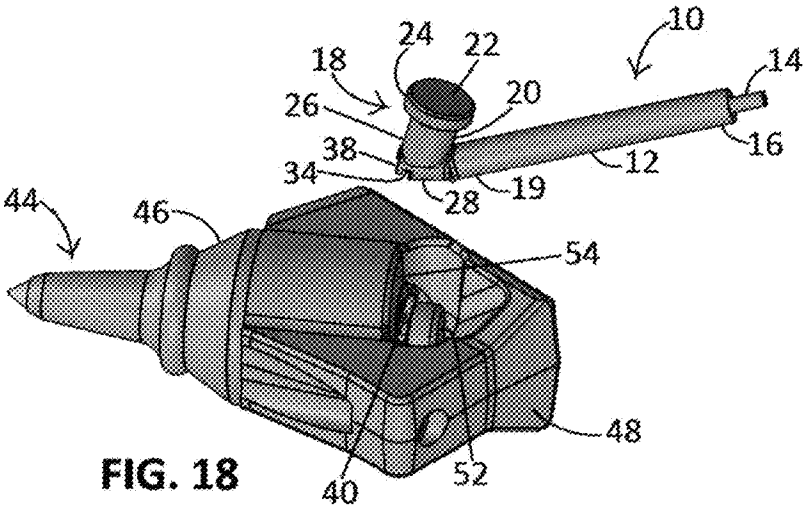
FIG. 18 is a side perspective view of the first embodiment of the retainer insertion and extraction tool, shown after the retainer is fully assembled onto the shank of the bit, in accordance with implementations of this disclosure.
Figure 19:
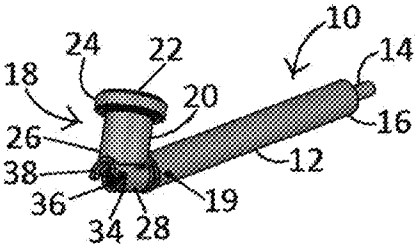
FIG. 19 is a perspective view of the first embodiment of the retainer insertion and extraction tool, shown after the retainer is fully assembled onto the shank of the bit, in accordance with implementations of this disclosure.
Figure 19:
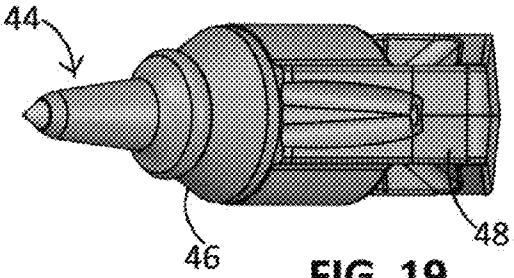
Figure 17:
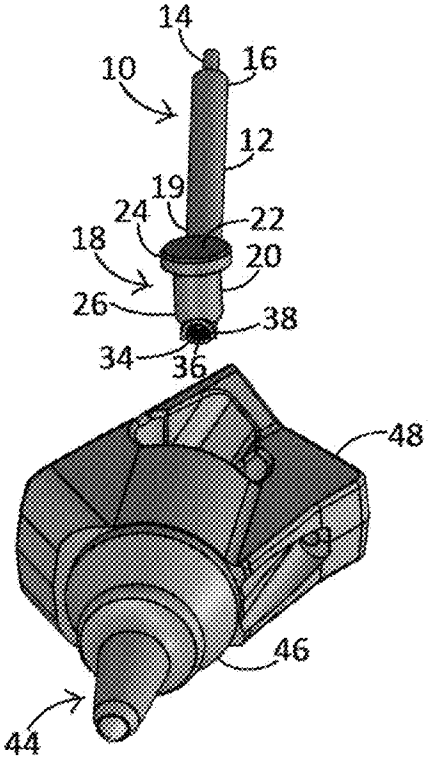
FIG. 17 is a top perspective view of the first embodiment of the retainer insertion and extraction tool, shown after the retainer is fully assembled onto the shank of the bit, in accordance with implementations of this disclosure.
Figure 20:
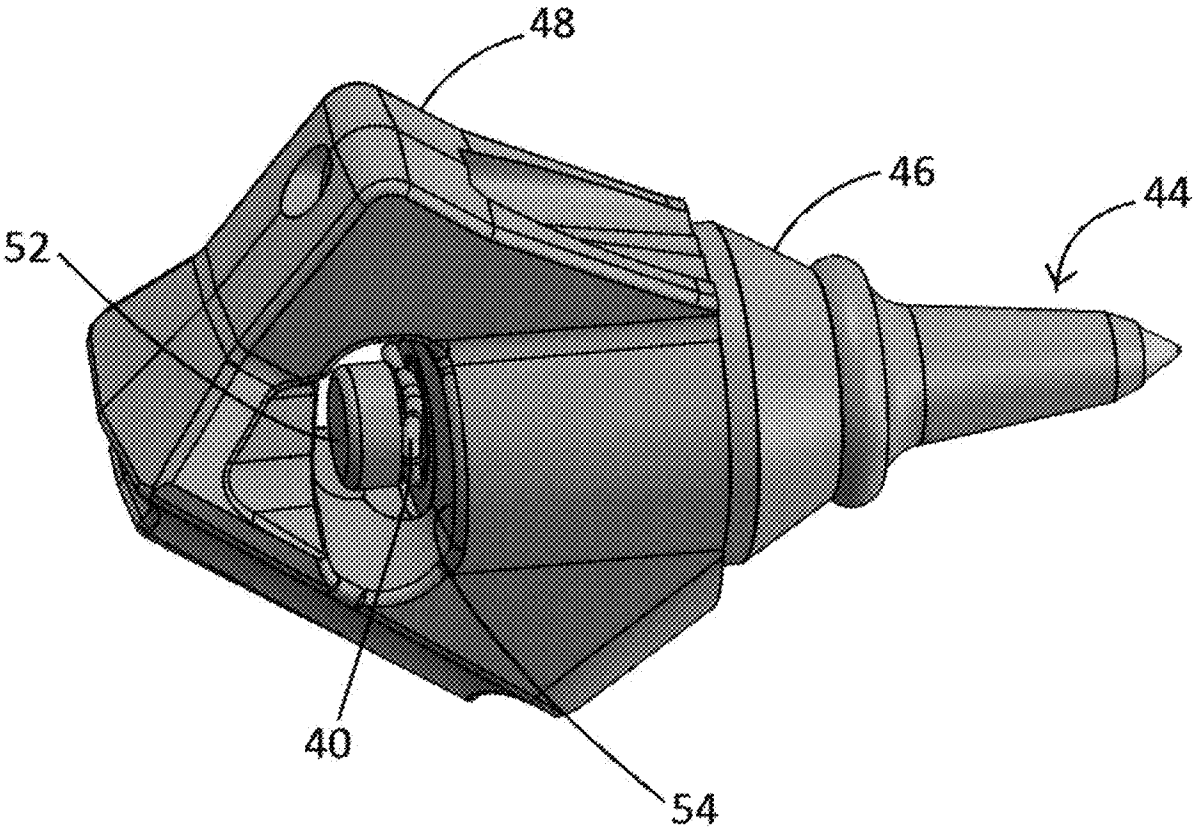
FIG. 20 is a side perspective view of a bit assembly, shown with the retainer fully assembled onto the shank of the bit, in accordance with implementations of this disclosure.
Figure 22:
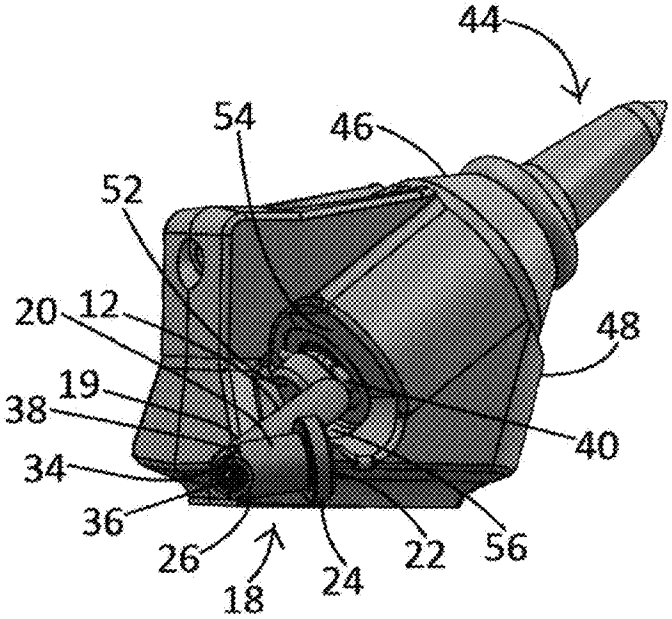
FIG. 22 is front perspective view of the first embodiment of the retainer insertion and extraction tool, showing a pin of the retainer insertion and extraction tool engaged with a top end of the retainer, in accordance with implementations of this disclosure.
Figure 21:
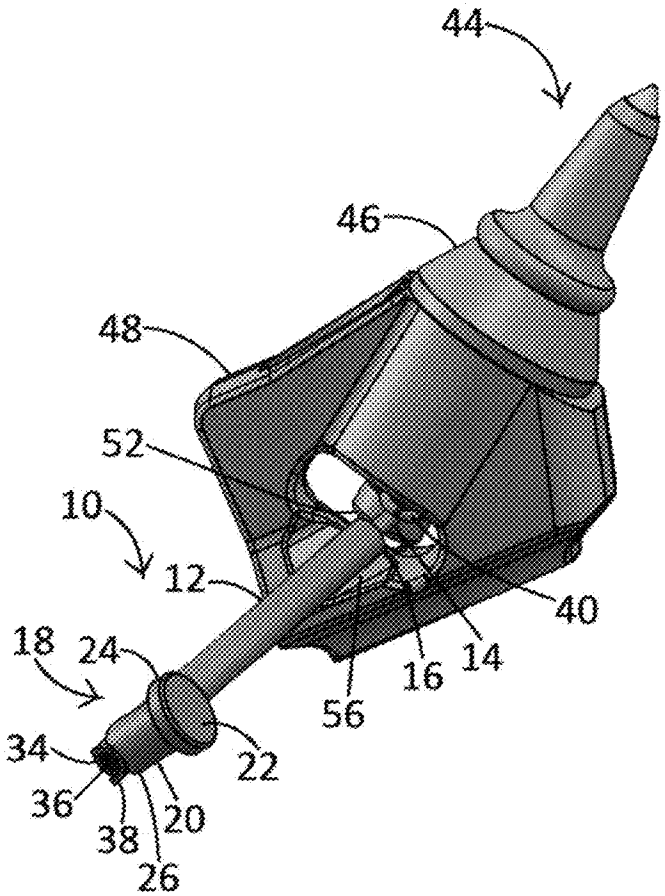
FIG. 21 is a top perspective view of the first embodiment of the retainer insertion and extraction tool, showing a pin of the retainer insertion and extraction tool engaged with a top end of the retainer, in accordance with implementations of this disclosure.
Figure 23:
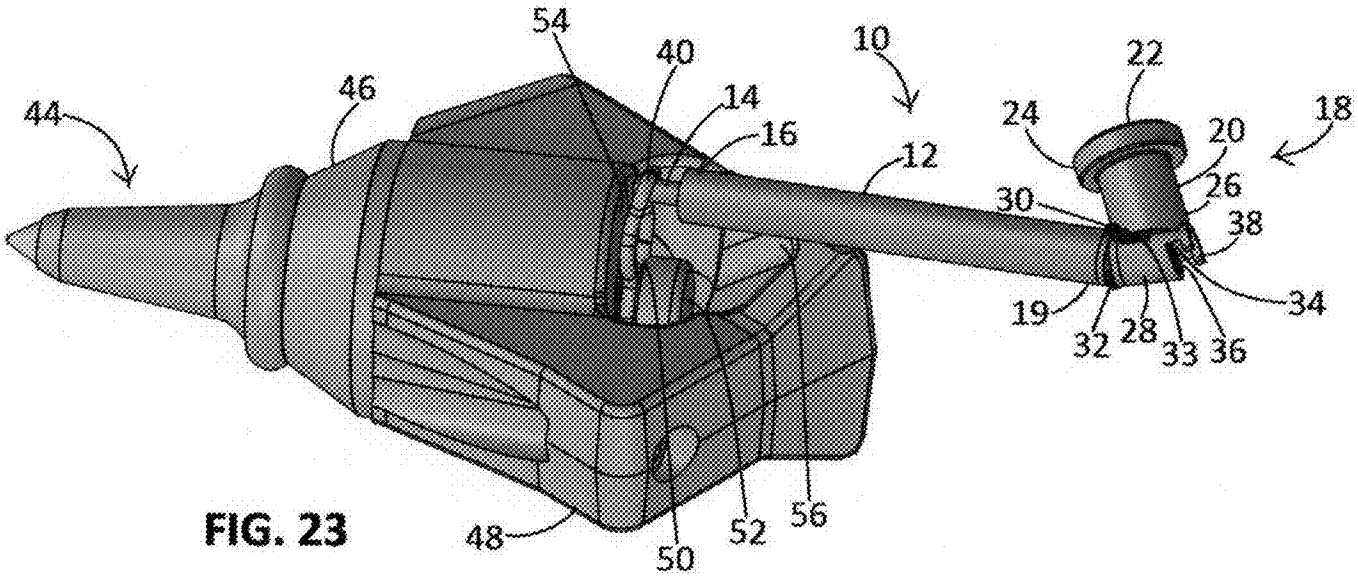
FIG. 23 is a side perspective view of the first embodiment of the retainer insertion and extraction tool, shown extracting the retainer from the shank of the bit, in accordance with implementations of this disclosure.
Figure 24:
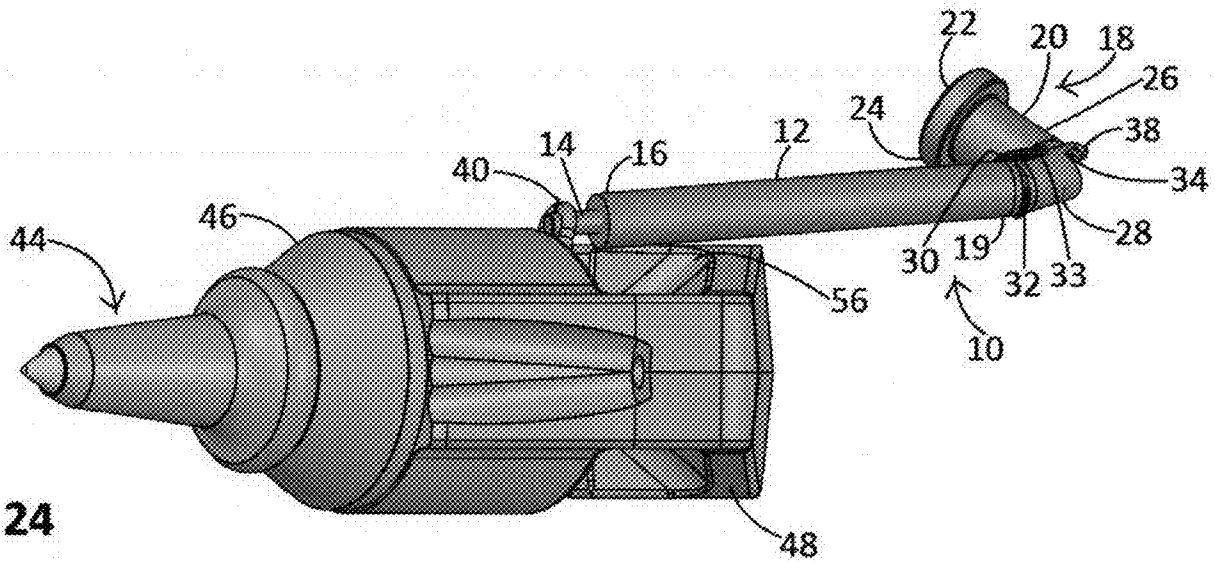
FIG. 24 is a top perspective view of the first embodiment of the retainer insertion and extraction tool, shown extracting the retainer from the shank of the bit, in accordance with implementations of this disclosure.

Referring to FIGS. 9-20, to use the retainer insertion and extraction tool 10 to insert the retainer 40 to the shank 42 of the bit 44, the bit 44 is first inserted into a bit sleeve or bit holder 46 within a base block 48. The shank 42 of the bit 44 includes an annular or cylindrical groove 50 adjacent a distal end 52 of the shank 42, the groove 50 having an axial length 53 that is at least a diameter 55 of the middle segment 43 of the retainer 40 as shown in FIG. 5. The groove 50 of the shank 42 can include an arcuate inner surface (not shown) or a flat inner surface 58 as shown in FIG. 10. Once the bit 44 is fully inserted within the bit holder 46 and base block 48, the groove 50 extends past a rear face 54 (FIGS. 10, 13, 18, 20, 22, and 23) of the base block 48, as shown in FIG. 13. The retainer 40 held within the retainer capture base 28 is positioned to be inserted into the shank 42 of the bit 44 so that legs 45 engage groove 50. When the legs 45 of the retainer 40 engage groove 50 of shank 42, a user applies manual force requiring only a hand slap to the hammer face 22 to fully insert the retainer 40 onto the shank 42 of the bit 44, such that the middle segment 43 of the retainer 40 grips the shank 42 in the groove 50 of the bit 44, as shown in FIGS. 18 and 20. The retainer insertion and extraction tool 10 is then pulled off from the retainer 40, as shown in FIGS. 17-19.

Figure 25:
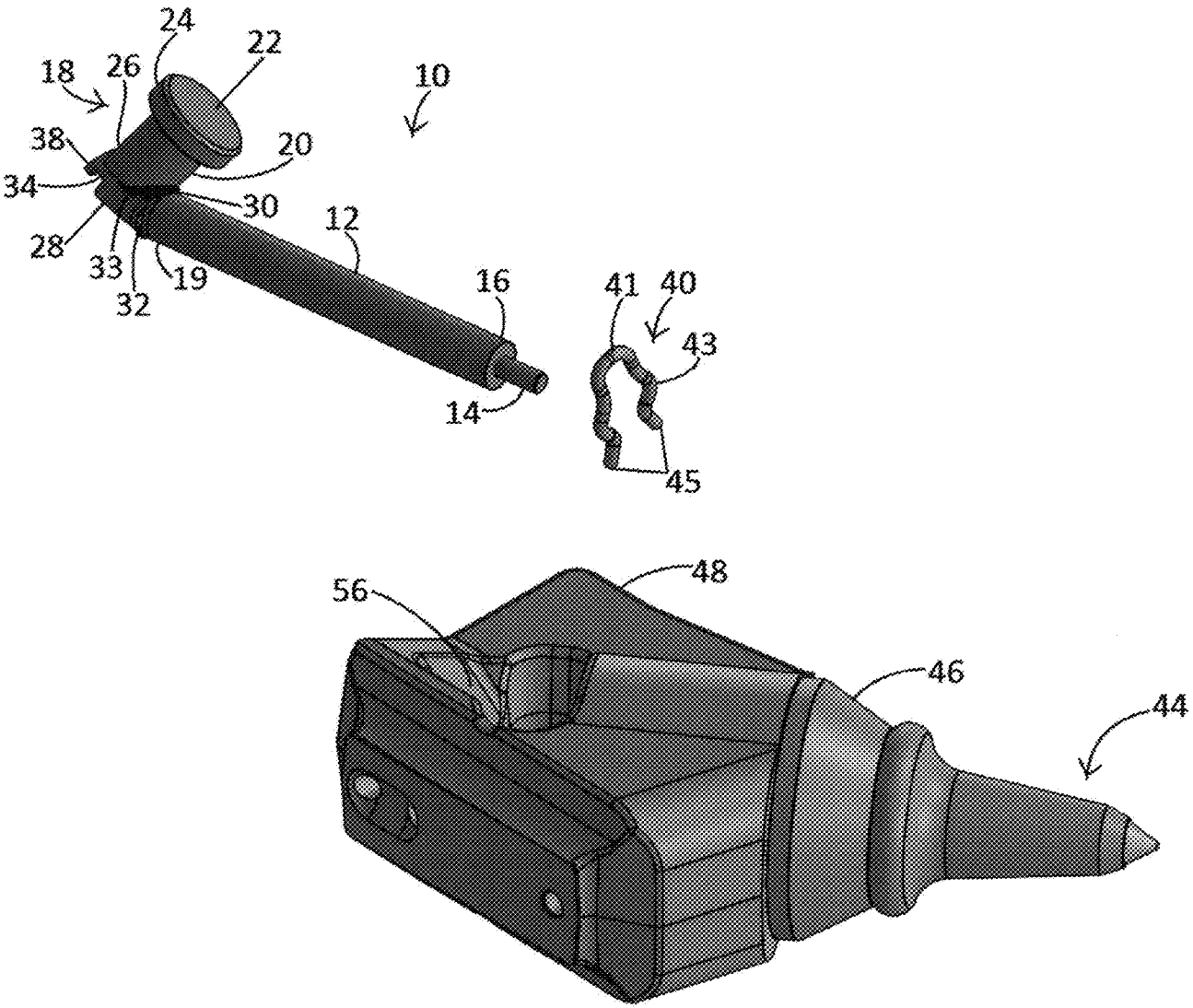
FIG. 25 is a side perspective view of the first embodiment of the retainer insertion and extraction tool, shown after extraction of the retainer from the shank of the bit, in accordance with implementations of this disclosure.
Figure 28:
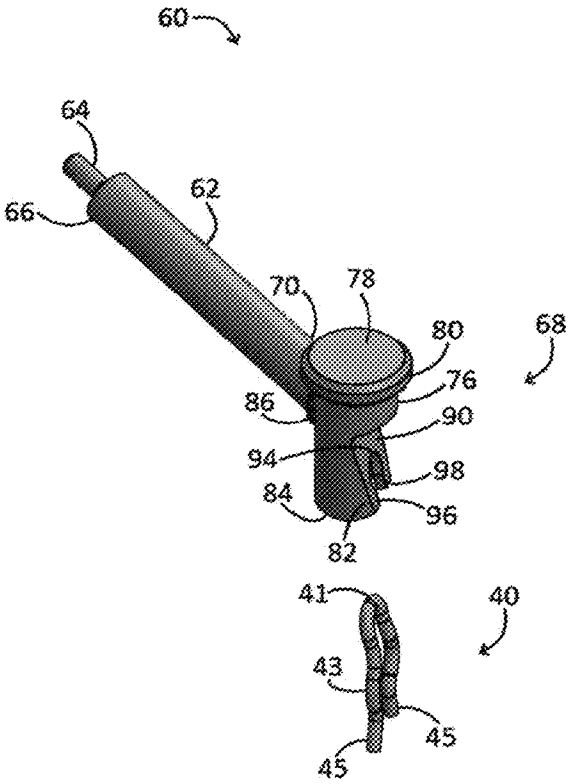
FIG. 28 is a side perspective view of the second embodiment of the retainer insertion and extraction tool, showing the retainer apart from the retainer insertion and extraction tool, in accordance with implementations of this disclosure.
Figure 27:
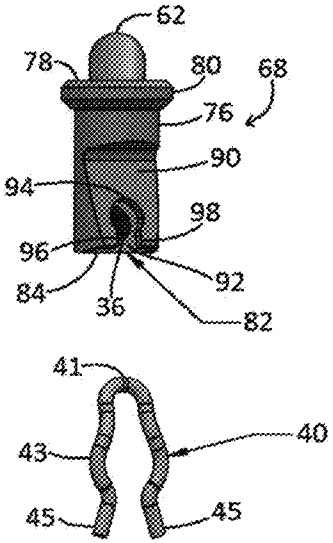
FIG. 27 is a front perspective view of the second embodiment of the retainer insertion and extraction tool, showing the retainer apart from the retainer insertion and extraction tool, in accordance with implementations of this disclosure.
Figure 26:
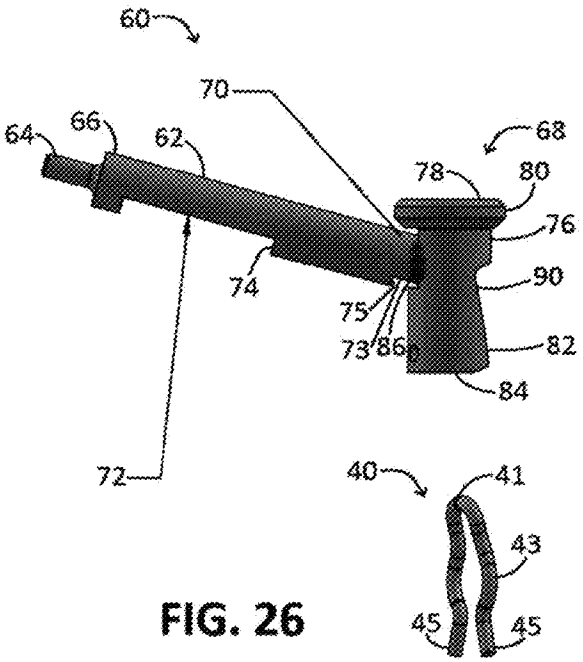
FIG. 26 is a side elevation view of a second embodiment of a retainer insertion and extraction tool, showing the retainer apart from the retainer insertion and extraction tool, in accordance with implementations of this disclosure.
Figure 30:
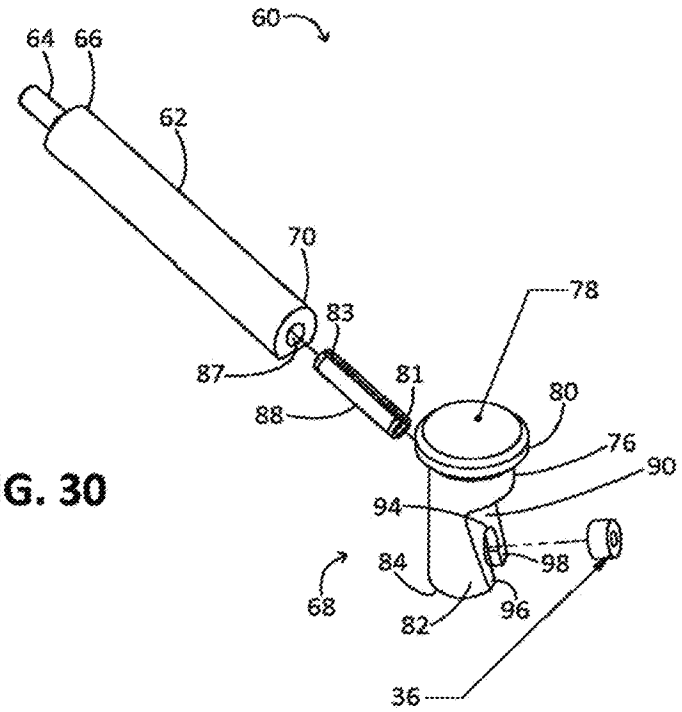
FIG. 30 is an exploded side perspective view of the second embodiment of the retainer insertion and extraction tool, showing the magnet apart from the retainer insertion and extraction tool, in accordance with implementations of this disclosure.
Figure 29:
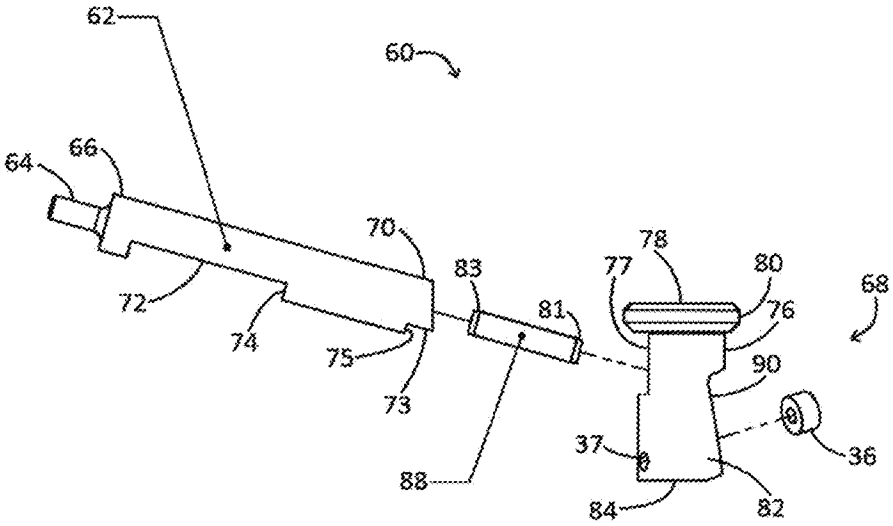
FIG. 29 is an exploded side elevation view of the second embodiment of the retainer insertion and extraction tool, showing the magnet apart from the retainer insertion and extraction tool, in accordance with implementations of this disclosure.

Referring to FIGS. 21-25, to use the retainer insertion and extraction tool 10 to extract the retainer 40 from the shank 42 of the bit 44, the retainer extraction pin 14 on the distal end 16 of the shaft 12 is inserted into the top segment 41 of the retainer 40. Once the retainer extraction pin 14 is engaged within the top segment 41, the user applies manual force requiring only a hand slap to the hammer face 22, allowing the shaft 12 to pivot against fulcrum 56 (FIGS. 21, 23-25) of the base block 48 and extract retainer 40 from the groove 50 of shank 42 of the bit 44, as shown in FIGS. 21-24. The retainer 40 is then pulled off from the retainer extraction pin 14 of the retainer insertion and extraction tool 10, as shown in FIG. 25.

Figure 33:
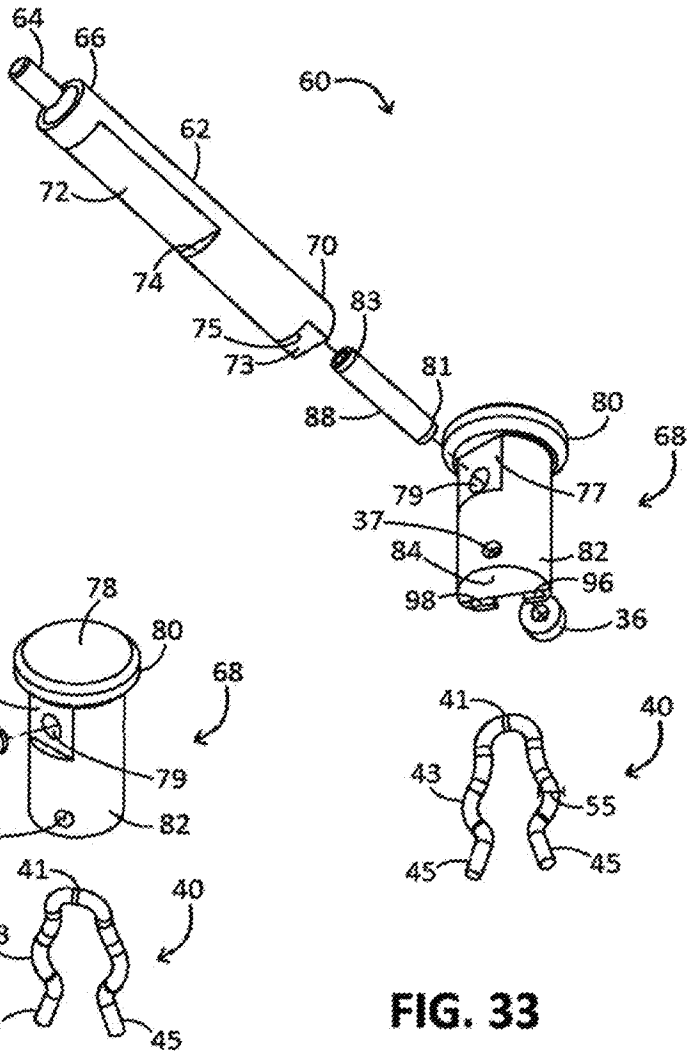
FIG. 33 is an exploded bottom perspective view of the second embodiment of the retainer insertion and extraction tool, showing the magnet and retainer apart from the retainer insertion and extraction tool, in accordance with implementations of this disclosure.
Figure 32:
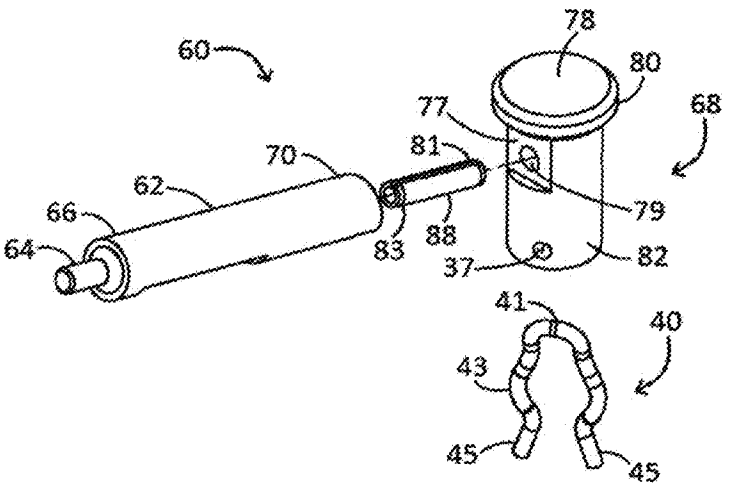
FIG. 32 is an exploded side perspective view of the second embodiment of the retainer insertion and extraction tool, showing the magnet and retainer apart from the retainer insertion and extraction tool, in accordance with implementations of this disclosure.
Figure 31:
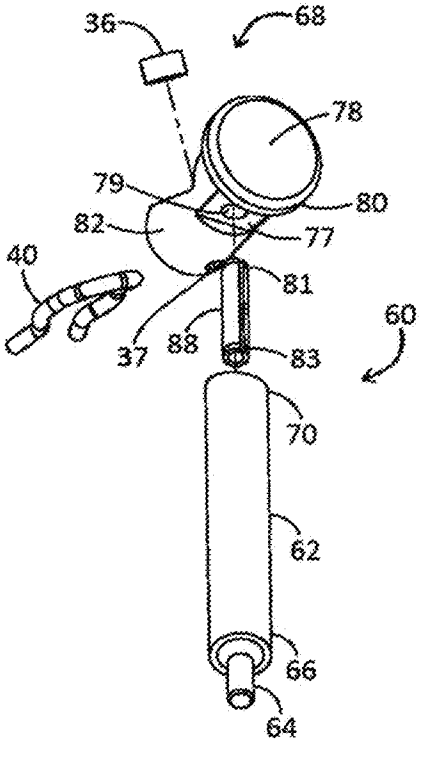
FIG. 31 is an exploded top perspective view of the second embodiment of the retainer insertion and extraction tool, showing the magnet and retainer apart from the retainer insertion and extraction tool, in accordance with implementations of this disclosure.
Figure 36:
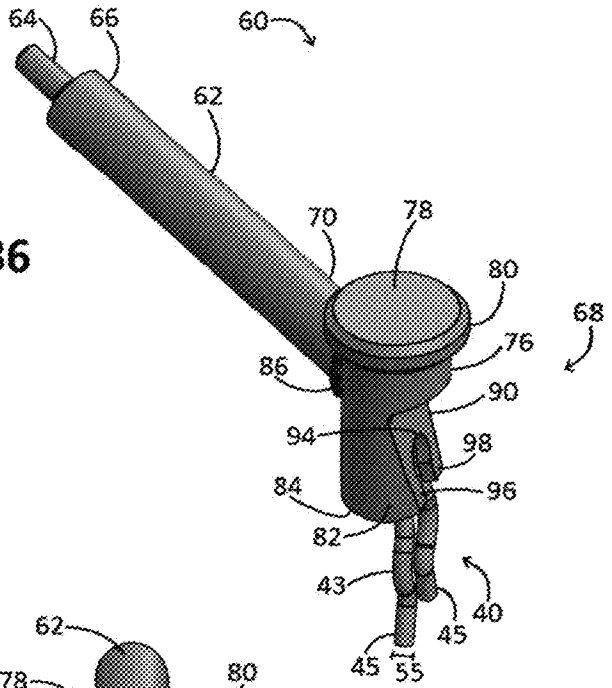
FIG. 36 is a side perspective view of the second embodiment of the retainer insertion and extraction tool, in accordance with implementations of this disclosure.
Figure 35:
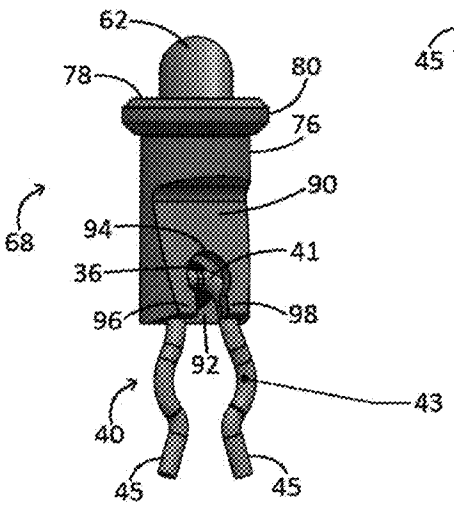
FIG. 35 is a front perspective view of the second embodiment of the retainer insertion and extraction tool, in accordance with implementations of this disclosure.
Figure 34:
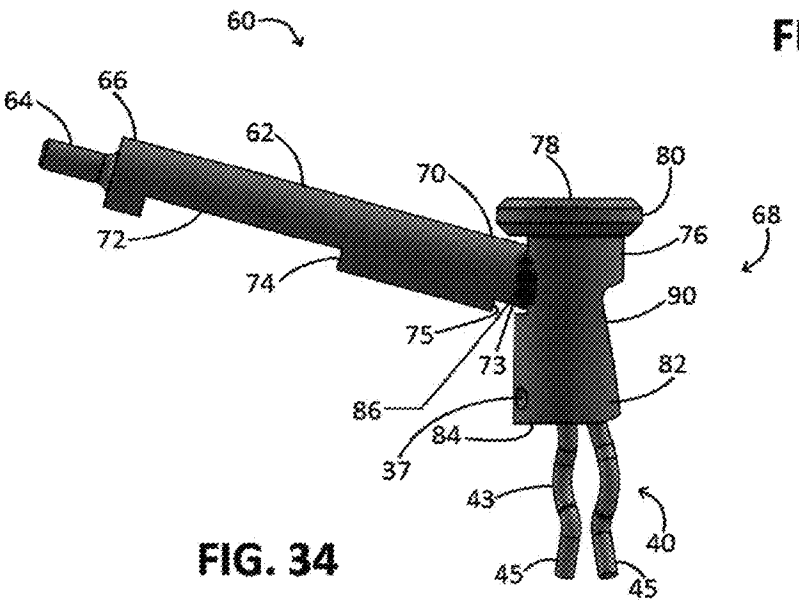
FIG. 34 is a rear side perspective view of the second embodiment of the retainer insertion and extraction tool, showing the retainer held by the retainer insertion and extraction tool, in accordance with implementations of this disclosure.
Figure 38:
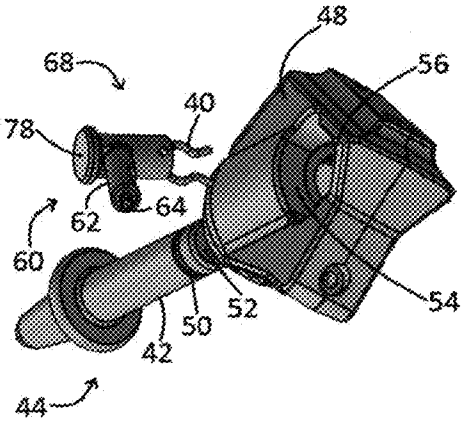
FIG. 38 is a rear perspective view of the second embodiment of the retainer insertion and extraction tool, shown prior to insertion of the bit and the retainer, in accordance with implementations of this disclosure.
Figure 37:
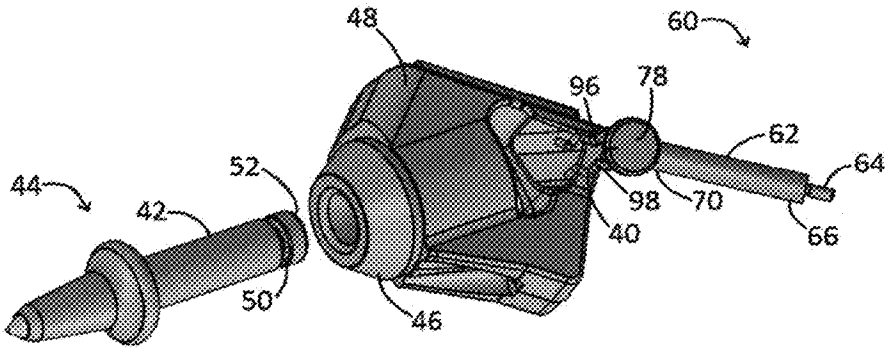
FIG. 37 is a side perspective view of the second embodiment of the retainer insertion and extraction tool, shown prior to insertion of a bit and the retainer, in accordance with implementations of this disclosure.
Figure 39:
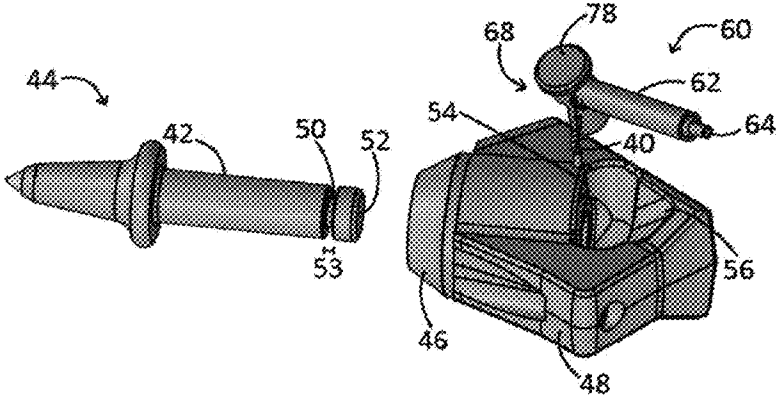
FIG. 39 is a rear side perspective view of the second embodiment of the retainer insertion and extraction tool, shown prior to insertion of the bit and the retainer, in accordance with implementations of this disclosure.

Referring to FIGS. 26-30, a second embodiment of a retainer insertion and extraction tool 60 comprises a shaft or handle 62, a retainer extraction pin 64 at a distal end 66 of the shaft 62, and a retainer receiving component 68 at a forward end 70 of the shaft 62. In other embodiments, the retainer extraction pin 64 can be a press fit dowel pin, a press fit roll pin, and/or a machined feature as an integral part of the shaft 62. The shaft 62 includes a first cutout portion 72 that axially extends from adjacent the distal end 66 of the shaft to a forward termination 74 and provides a relief zone for deeper positioning of the shaft 62 onto the fulcrum 56 and into the base block 48. The shaft 62 also includes a second cutout portion 73 that axially extends from the forward end 70 to a distal termination 75. The shaft 62 includes a bore 87 (FIG. 30) that axially extends from the forward end 70 of the shaft and receives a distal end 83 of a roll or tubular spring pin 88 (FIGS. 29 and 30) that is coaxial with the shaft 62. The retainer receiving component 68 comprises a cutout portion 77 that includes an aperture 79 configured to receive a forward end 81 of the spring pin 88, as shown in FIGS. 31-33. The spring feature in the slotted spring pin 88 allows the forward end 81 and the distal end 83 of the spring pin 88 to collapse. Due to the complex angles between the shaft 62 and the retainer receiving component 68, the bore 87 in shaft 62, surface 77, and aperture 79 can be accurately milled and/or drilled by a CNC machine rather than trying to align the shaft 62 and the retainer receiving component 68 by fixturing these components. The retainer receiving component 68 also comprises an annular or generally cylindrical hammer face mounting 76, a hammer face 78 at a top end 80 of the generally cylindrical hammer face mounting 76, and a retainer capture base 82 at a bottom end 84 of the generally cylindrical hammer face mounting 76. In this illustrated embodiment, the generally cylindrical hammer face mounting 76 is fastened to the shaft 62 on both sides, at location 85 (FIGS. 40 and 42-45) and location 86 (FIGS. 34, 36, 40, and 42), at an acute angle to the shaft 62 using welding. In other embodiments, the generally cylindrical hammer face mounting 76 can be fastened using braising, or any other fastening means as is known in the art. In another embodiment, the shaft 66 and the generally cylindrical hammer face mounting 76 can be integrally formed in one piece.

Referring to FIGS. 27-30, the generally cylindrical hammer face mounting 76 comprises an angular L-shaped milled surface 90 opposite the cutout portion 77 (FIGS. 29 and 31-33), in this illustrated embodiment, that corresponds to the L-shaped rear face 54 of the base block 48 and allows for a greater angle between the shaft 62 and the base block 48. The retainer capture base 82 comprises an arcuate, annular, and/or cylindrical notch 92 configured to receive and engage the magnet 36. The retainer capture base 82 also comprises an aperture 37 (FIGS. 29-34) opposite the notch 92 that is configured to allow a user to knock out or push out the magnet 36 from the notch 92. The retainer capture base 82 comprises an extending leading edge 94 that includes a pair of diametrically smaller opposite legs 96, 98 that, in combination with the cylindrical notch 92 and magnet 36, is configured to receive and retain the retainer 40. The magnet 36 and the leading edge 94 both function to maintain the retainer 40 within the retainer capture base 82, shown in FIGS. 31-33, prior to insertion of the retainer 40 onto the shank 42 of the bit 44.

Figure 40:
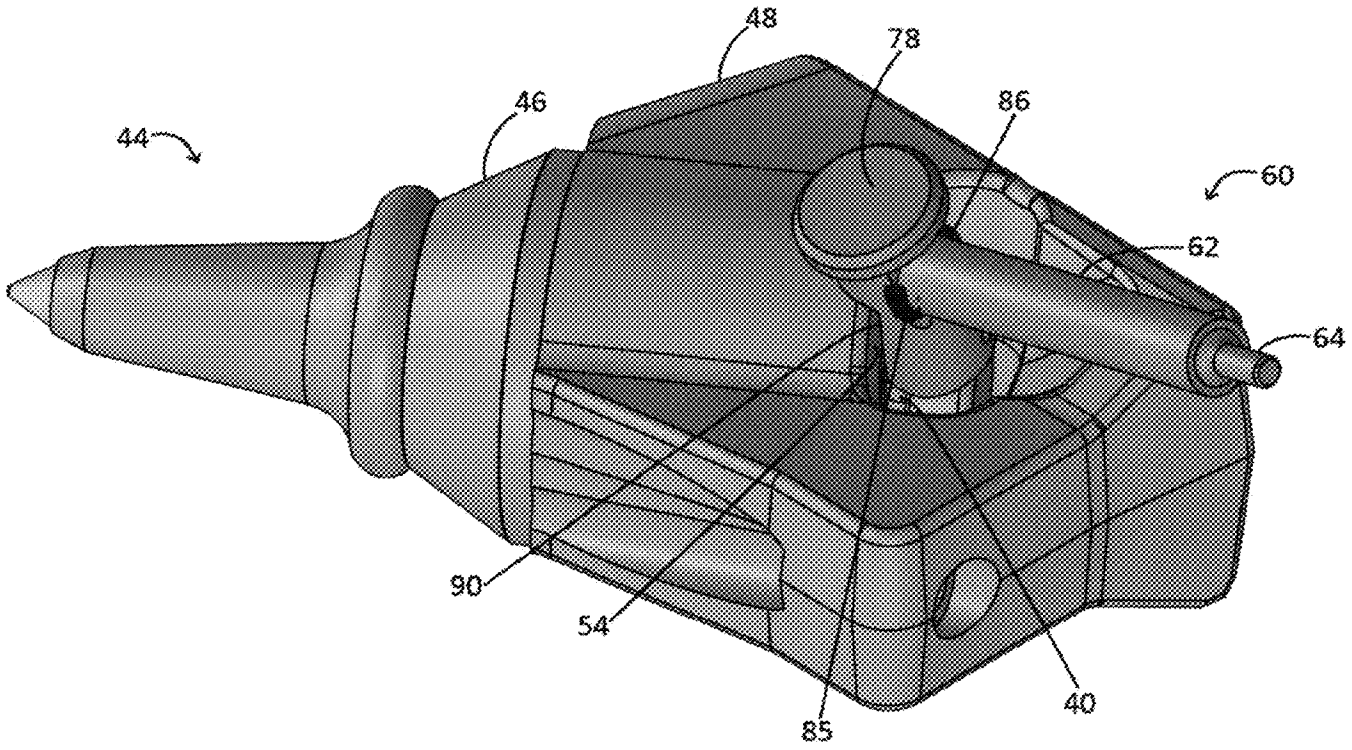
FIG. 40 is a top perspective view of the second embodiment of the retainer insertion and extraction tool, shown positioned when the retainer is fully inserted onto a shank of the bit, in accordance with implementations of this disclosure.
Figure 41:
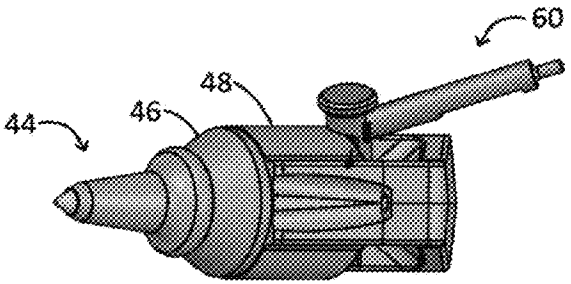
FIG. 41 is a side perspective view of the second embodiment of the retainer insertion and extraction tool, shown positioned when the retainer is fully inserted onto the shank of the bit, in accordance with implementations of this disclosure.
Figure 42:
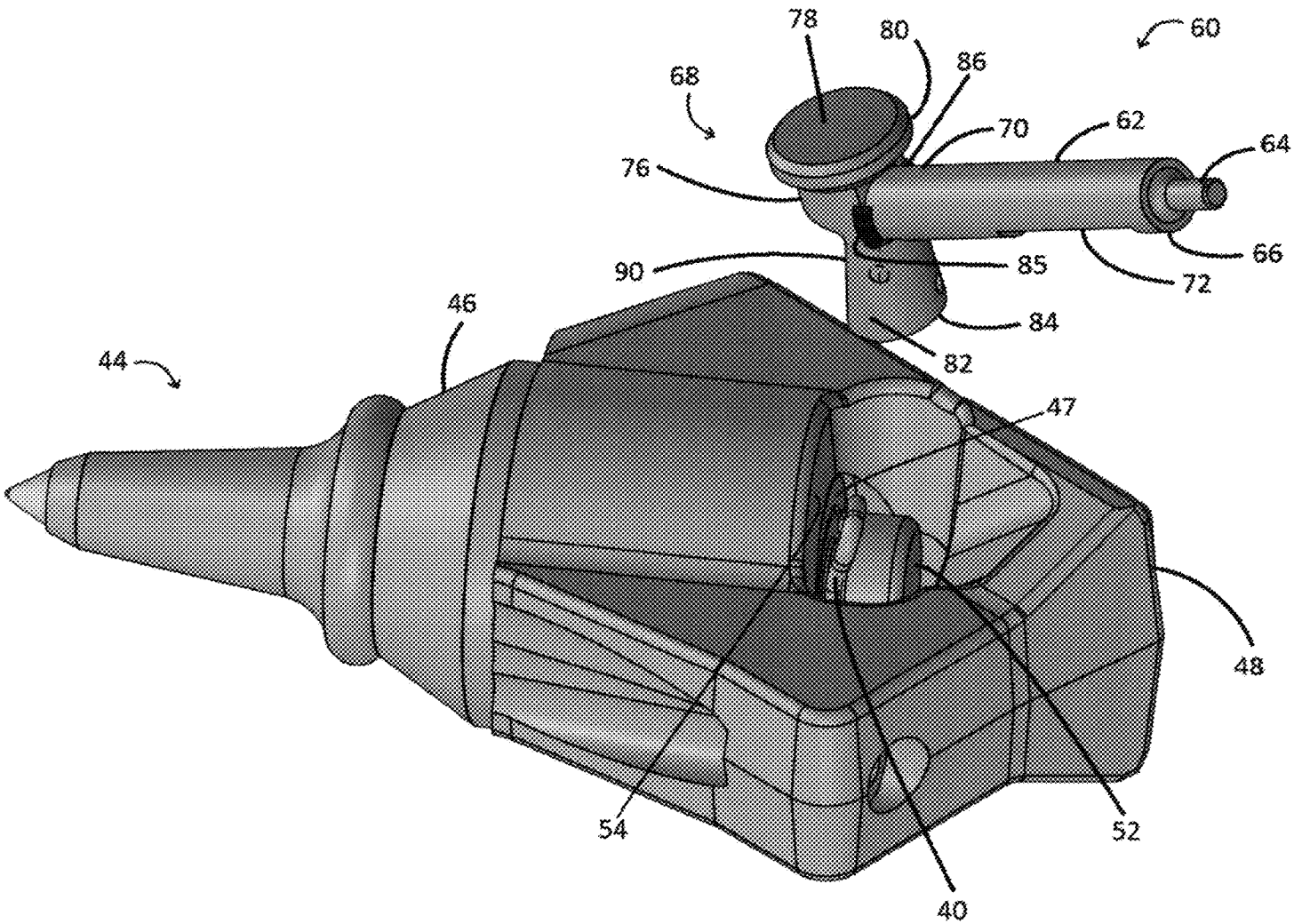
FIG. 42 is a side perspective view of the second embodiment of the retainer insertion and extraction tool, shown after the retainer is fully assembled onto the shank of the bit, in accordance with implementations of this disclosure.
Figure 43:
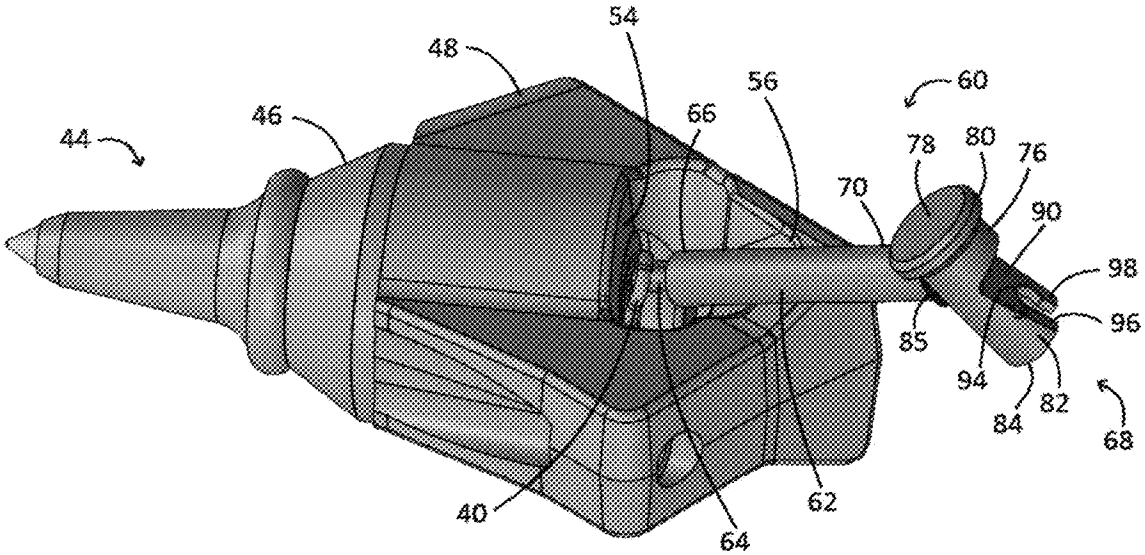
FIG. 43 is a top-side perspective view of the second embodiment of the retainer insertion and extraction tool, showing a pin of the retainer insertion and extraction tool engaged with a top end of the retainer, in accordance with implementations of this disclosure.
Figure 44:
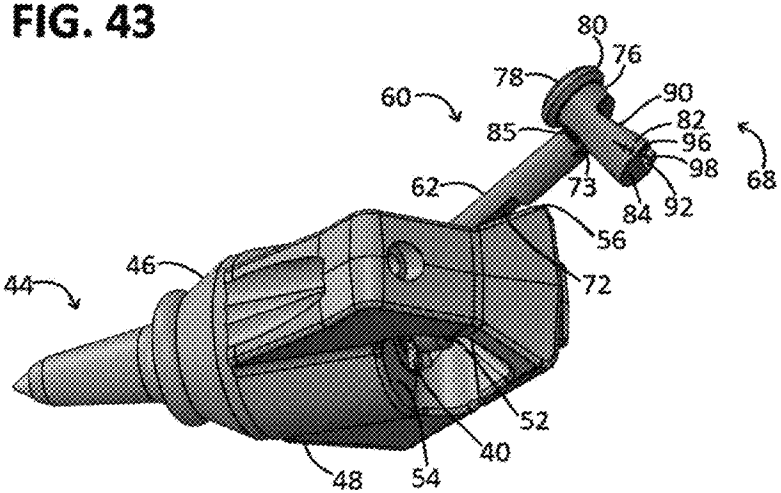
FIG. 44 is a bottom-side perspective view of the second embodiment of the retainer insertion and extraction tool, showing the retainer insertion and extraction tool engaged with the retainer, in accordance with implementations of this disclosure.
Figure 45:
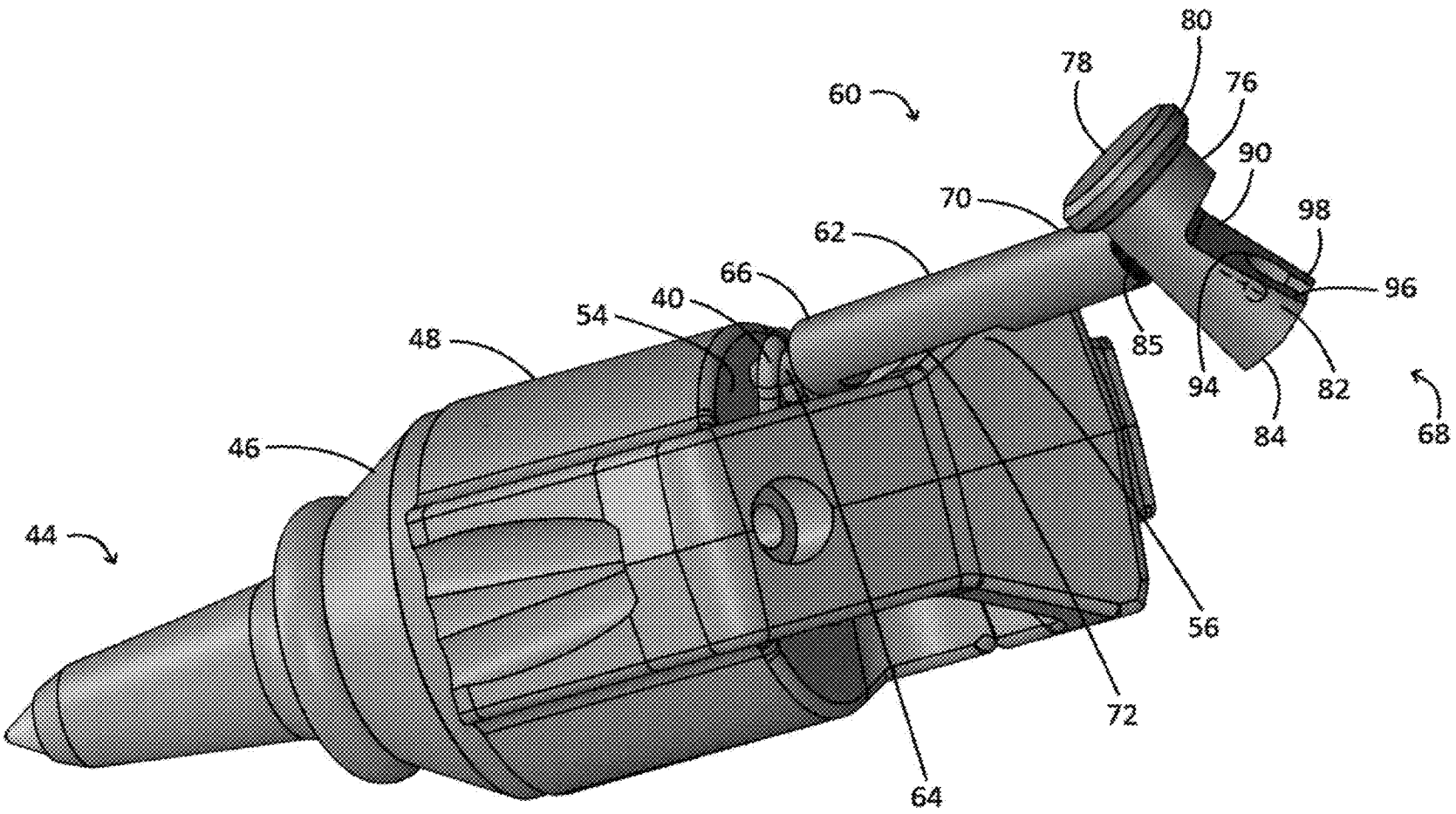
FIG. 45 is a side perspective view of the second embodiment of the retainer insertion and extraction tool, showing the pin of the retainer insertion and extraction tool engaged with the top end of the retainer, in accordance with implementations of this disclosure.
Figure 47:
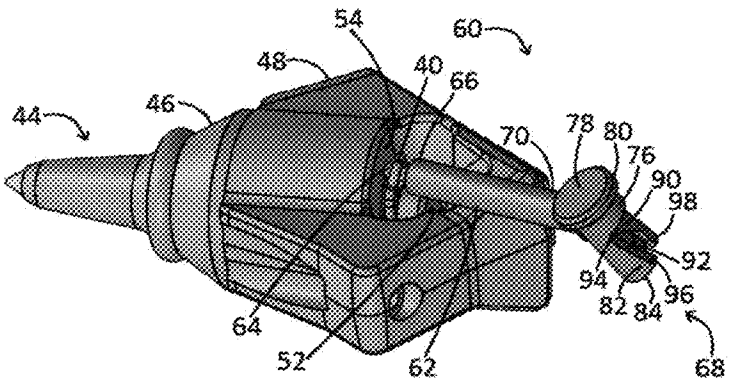
FIG. 47 is a top-side perspective view of the second embodiment of the retainer insertion and extraction tool, showing the pin of the retainer insertion and extraction tool engaged with the top end of the retainer, in accordance with implementations of this disclosure.
Figure 46:
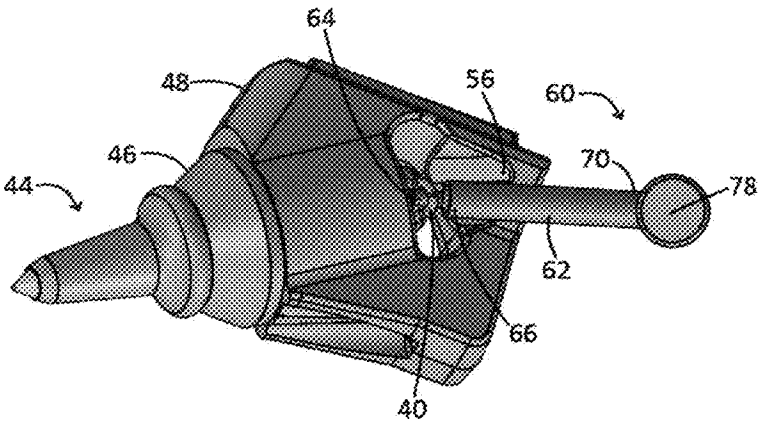
FIG. 46 is a side perspective view of the second embodiment of the retainer insertion and extraction tool, showing the pin of the retainer insertion and extraction tool engaged with the top end of the retainer, in accordance with implementations of this disclosure.
Figure 48:
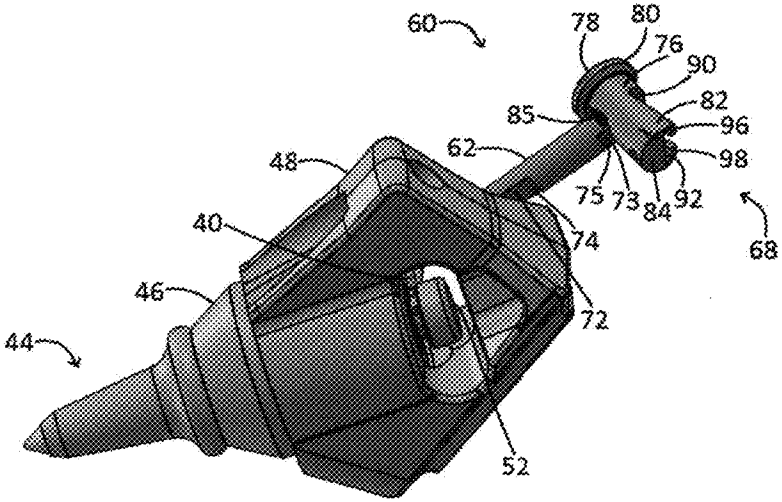
FIG. 48 is a bottom-side perspective view of the second embodiment of the retainer insertion and extraction tool, showing the pin of the retainer insertion and extraction tool engaged with the top end of the retainer, in accordance with implementations of this disclosure.
Figure 49:
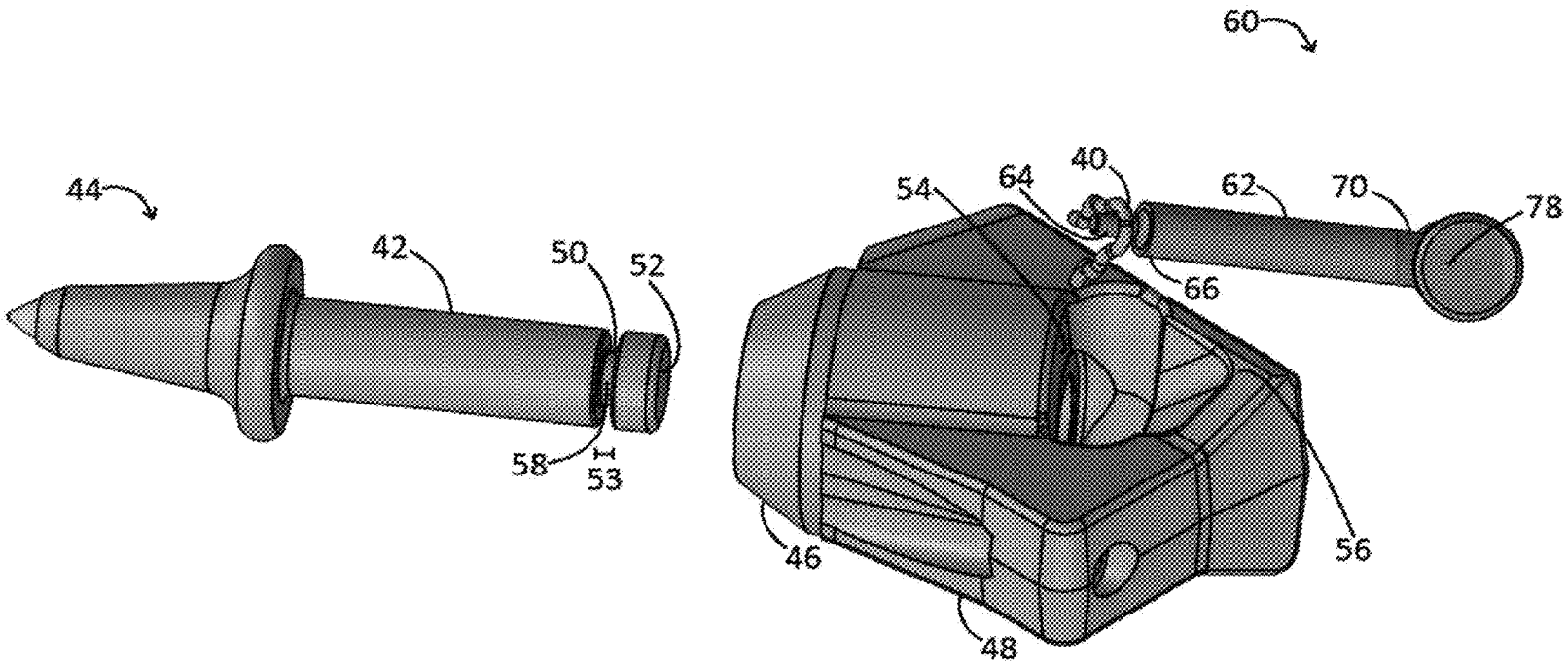
FIG. 49 is a top-side perspective view of the second embodiment of the retainer insertion and extraction tool, shown after extraction of the retainer from the shank of the bit and extraction of the bit from a bit holder, a bit sleeve, and/or a bit holder block, in accordance with implementations of this disclosure.

Referring to FIGS. 34-39, to use the retainer insertion and extraction tool 60 to insert the retainer 40 to the shank 42 of the bit 44, the bit is first inserted into the bit holder 46 within the base block 48. The shank 42 of the bit 44 includes the annular or cylindrical groove 50 adjacent the distal end 52 of the shank 42, the groove 50 having the axial length 53 that is at least the diameter 55 of the middle segment 43 of the retainer 40 as shown in FIG. 33. The groove 50 of the shank 42 can include an arcuate inner surface (not show) or the flat inner surface 58 as shown in FIG. 49. A distal end 47 (FIG. 42) of the bit sleeve or bit holder 46 can extend past the rear face 54 of the base block 48. Once the bit 44 is fully inserted within the bit holder 46 and base block 48, as shown in FIG. 42, the distal end 52 of the shank 42 will extend past the distal end of the bit holder 46 and the groove 50 will extend past the distal end of the bit holder 46 and the rear face 54 of the base block 48. The retainer 40 held within the retainer capture base 82 is positioned to be inserted into the shank 42 of the bit 44 so that legs 45 engage groove 50. When the legs 45 of the retainer 40 engage groove 50 of shank 42, the user applies manual force requiring only a hand slap to the hammer face 78 to fully insert the retainer 40 onto the shank 42 of the bit 44, such that the middle segment 43 of the retainer 40 grips the shank 42 in the groove 50 of the bit 44, as shown in FIG. 42, and the milled surface 90 seats along the rear face 54 of the base block 48, as shown in FIGS. 40 and 41. The retainer insertion and extraction tool 60 is then pulled off from the retainer 40, as shown in FIG. 42.

Referring to FIGS. 43-49, to use the retainer insertion and extraction tool 60 to extract the retainer 40 from the shank 42 of the bit 44, the retainer extraction pin 64 on the distal end 66 of the shaft 62 is inserted into the top segment 41 of the retainer 40 and the cutout portion 72 is positioned on the fulcrum 56 of the base block 40, as shown in FIGS. 43-48. Once the retainer 40 is engaged within the top segment 41, the user applies manual force requiring only a hand slap to the hammer face 78, allowing the cutout portion 72 of the shaft 62 to pivot against fulcrum 56 (FIGS. 43-48) of the base block 48 and extract the retainer 40 from the groove 50 of shank 42 of the bit 44. Retainer 40 is then pulled off from the retainer extraction pin 64 of the retainer insertion and extraction tool 60, as shown in FIG. 49.

While the present disclosure has been described in connection with certain embodiments, it is to be understood that the invention is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A tool for insertion and extraction of a retainer on a bit in a base block comprising:

a generally cylindrical first shaft of a first diameter;

a generally cylindrical second shaft of a lesser second diameter than said first shaft, the second shaft extending past a distal end of the first shaft;

a solid receiving component fastened at an acute angle to a forward end of the first shaft; and a notch extending along a longitudinal axis of the notch, the longitudinal axis of the notch parallel to a longitudinal axis of the receiving component, the notch adapted to receive the retainer.

2. The tool of claim 1, further comprising:

a base at a bottom end of the receiving component, the notch disposed in a forward end of the base;

one of an annular mounting and a cylindrical mounting adjacent the base; and a planar surface adjacent one of the annular mounting and the cylindrical mounting and opposite the base, the planar surface adapted to allow the user to insert the retainer around a shank of the bit when force is applied to the planar surface.

3. The tool of claim 2, further comprising:

a magnet mounted in an aperture extending from the forward end of the base towards a distal end of the base, the aperture having a termination adjacent the forward end of the base; and an annular leading face at the forward end of the base, the annular leading face including a planar extension from the notch, the annular leading face and the magnet adapted to hold the retainer in the notch.

4. The tool of claim 1, wherein the notch is hollow and is one of an arcuate notch, a generally cylindrical notch, and a cylindrical notch.

5. A tool for insertion and extraction of a retainer on a bit in a base block comprising:

a first shaft of a first diameter;

a second shaft of a lesser second diameter that said first shaft, the second shaft extending past a distal end of the first shaft;

a solid receiving component fastened at an acute angle to a forward end of the shaft; and a notch extending along a longitudinal axis of the notch, the longitudinal axis of the notch askew to a longitudinal axis of the receiving component, the notch adapted to receive the retainer.

6. The tool of claim 5, wherein the second lesser diameter shaft is configured to be inserted into a top segment of the retainer to remove the retainer from the shaft of the bit.

7. The tool of claim 5, further comprising:

a first substantially flat cutout pivot portion extending along an axis parallel to a longitudinal axis of the first shaft, the first substantially flat cutout pivot portion extending from adjacent a distal end of the first shaft to a forward termination along the first shaft, the first substantially flat cutout pivot portion adapted to provide for providing leverage at said second lesser diameter shaft; and a second cutout portion extending along the axis parallel to the longitudinal axis of the first shaft, the second cutout portion extending from the forward end of the first shaft to a distal termination along the first shaft, the distal termination adjacent the forward termination the second cutout portion adapted to for matingly engage said receiving component.

8. The tool of claim 5, further comprising:

a roll pin comprising a first end and a second end;

a bore extending inwardly from the forward end of the first shaft along an axis of the first shaft, the bore adapted to receive the second end of the roll pin; and an aperture disposed on a cutout portion of the receiving component adjacent the forward end of the first shaft, the aperture configured to receive the first end of the roll pin to fix the first shaft to the receiving component.

9. The tool of claim 8, wherein the roll pin is configured to allow the diameter of the first end and the second end of the roll pin to collapse.

10. The tool of claim 5, further comprising:

an enlarged planar impact surface at a top end of the receiving component; and one of the annular mounting and a cylindrical mounting adjacent the planar impact surface on the receiving component, the planar impact surface adapted to allow an impact tool of the user to insert the retainer around a shank of the bit when force is applied to the planar impact surface.

11. The tool of claim 10, wherein:

one of the annular mounting and the cylindrical mounting is fastened to the first shaft on each side of the receiving component.

12. The tool of claim 10, further comprising:

an angular surface of the receiving component opposite the first shaft, the angular surface configured to correspond to a rear face of a base block.

13. The tool of claim 10, the receiving component comprises:

a base portion at a bottom end of one of the annular mounting and the cylindrical mounting;

the notch disposed adjacent a front end of the base;

a magnet mounted in an aperture extending from the front end of the base portion towards a distal end of the base portion, the aperture including a termination adjacent the forward end of the base portion; and a leading edge extending forwardly from the notch, the leading edge and the magnet adapted to hold the retainer in the notch.

14. The tool of claim 13, wherein the notch is one of an arcuate notch, a generally cylindrical notch, and a cylindrical notch.

15. The tool of claim 13, further comprising:

a bore disposed in the base portion along an axis askew to the longitudinal axis of the receiving component, the bore adapted to allow a user to push the magnet out of the aperture and remove the magnet from the base portion.

16. The tool of claim 5, wherein the notch is hollow and is one of an arcuate notch, a generally cylindrical notch, and a cylindrical notch.

* * * * *